US010763028B2

(12) United States Patent
Zhou et al.

(10) Patent No.: US 10,763,028 B2
(45) Date of Patent: Sep. 1, 2020

(54) MAGNETIC COMPONENT AND MAGNETIC CORE OF THE SAME

(71) Applicant: DELTA ELECTRONICS, INC., Taoyuan (TW)

(72) Inventors: Jin-Ping Zhou, Taoyuan (TW); Rui Wu, Taoyuan (TW); Jian-Hong Zeng, Taoyuan (TW); Yu Zhang, Taoyuan (TW); Min Zhou, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 383 days.

(21) Appl. No.: 15/464,326

(22) Filed: Mar. 20, 2017

(65) Prior Publication Data

US 2017/0194086 A1 Jul. 6, 2017

Related U.S. Application Data

(63) Continuation-in-part of application No. 15/092,629, filed on Apr. 7, 2016.

(30) Foreign Application Priority Data

| | | |
|---|---|---|
| Apr. 10, 2015 | (CN) | 2015 1 0169368 |
| Jul. 27, 2015 | (CN) | 2015 1 0446385 |
| Mar. 24, 2016 | (CN) | 2016 1 0173671 |

(51) Int. Cl.

| | |
|---|---|
| ***H01F 27/24*** | (2006.01) |
| ***H01F 3/14*** | (2006.01) |
| ***H01F 27/28*** | (2006.01) |
| ***H01F 27/00*** | (2006.01) |
| ***H01F 37/00*** | (2006.01) |
| ***H01F 3/10*** | (2006.01) |

(52) U.S. Cl.
CPC ..... *H01F 27/24* (2013.01); *H01F 3/10* (2013.01); *H01F 3/14* (2013.01); *H01F 27/006* (2013.01); *H01F 27/2823* (2013.01); *H01F 37/00* (2013.01); *H01F 2003/106* (2013.01)

(58) Field of Classification Search
CPC ..... H01F 27/24; H01F 3/14
See application file for complete search history.

(56) References Cited

U.S. PATENT DOCUMENTS 3,659,191 A * 4/1972 Spreadbury ..... G05F 3/06 323/248
4,547,705 A 10/1985 Hirayama et al.
(Continued)

FOREIGN PATENT DOCUMENTS

CN 201689765 U 12/2010
CN 101989485 A 3/2011
(Continued)

*Primary Examiner* — Elvin G Enad
*Assistant Examiner* — Malcolm Barnes
(74) *Attorney, Agent, or Firm* — CKC & Partners Co., LLC

(57) ABSTRACT

A magnetic core is provided. The magnetic core includes a plurality of magnetic core units each having at least one non-shared magnetic core part that is not shared with the neighboring magnetic core unit, wherein a reluctance of the shared magnetic core part is smaller than the reluctance of a non-shared magnetic core part of the magnetic core units, and directions of a direct current magnetic flux in the shared magnetic core part of the neighboring two magnetic core units are opposite.

19 Claims, 21 Drawing Sheets

(56) References Cited

U.S. PATENT DOCUMENTS 4,599,985 A * 7/1986 Betz ..... F02P 3/02 123/621
4,665,357 A 5/1987 Herbert
5,257,000 A 10/1993 Billings et al.
6,040,753 A 3/2000 Ramakrishnan et al.
6,661,327 B1 12/2003 Funk
2003/0231094 A1 12/2003 Funk
2005/0093672 A1 5/2005 Harding
2006/0066292 A1* 3/2006 Tadatsu ..... G01R 15/183 324/117 H
2006/0145800 A1* 7/2006 Dadafshar ..... H01F 27/2847 336/82
2006/0197510 A1 9/2006 Chandrasekaran
2008/0265858 A1* 10/2008 Muratov ..... H02M 3/1584 323/301
2009/0257560 A1* 10/2009 Khutoryansky ..... H01F 30/12 378/101
2010/0085139 A1 4/2010 Yan et al.
2011/0063065 A1* 3/2011 Hugues Douglas ..... H01F 3/10 336/170
2011/0279212 A1* 11/2011 Ikriannikov ..... H01F 17/0006 336/192
2012/0062207 A1* 3/2012 Ikriannikov ..... H01F 38/08 323/361
2012/0256719 A1* 10/2012 Shudarek ..... H02J 3/01 336/179
2013/0027169 A1 1/2013 Yan et al.
2013/0033351 A1* 2/2013 Kim ..... H01F 27/28 336/170
2014/0043127 A1* 2/2014 Worek ..... H01F 27/38 336/178
2014/0266534 A1* 9/2014 Shi ..... H01F 3/14 336/178
2014/0313002 A1 10/2014 Kuo et al.
2015/0287512 A1* 10/2015 Winkler ..... H01F 27/24 336/178
2017/0047155 A1 2/2017 Yao et al.
2017/0278606 A1* 9/2017 Kondou ..... H01F 3/14

FOREIGN PATENT DOCUMENTS

CN 102314998 A 1/2012
EP 2299456 A1 3/2011
TW 200304721 A 10/2003
TW 201248661 A 12/2012
TW 201442046 A 11/2014
WO 2016006198 A1 1/2016

* cited by examiner

MAGNETIC COMPONENT AND MAGNETIC CORE OF THE SAME

RELATED APPLICATIONS

The present application is a continuation-in-part application of U.S. application Ser. No. 15/092,629, filed Apr. 7, 2016, which claims priority to Chinese Application Serial Number 201510169368.5, filed Apr. 10, 2015 and Chinese Application Serial Number 201510446385.9, filed Jul. 27, 2015, which is herein incorporated by reference. The present application claims priority to Chinese Application Serial Number 201610173671.7, filed Mar. 24, 2016, which is herein incorporated by reference.

BACKGROUND

Field of Invention

The present disclosure relates to a power technology. More particularly, the present disclosure relates to a magnetic component and a magnetic core of the same.

Description of Related Art

In recent years, miniaturization of power converter is an important trend of the development of power technology. In a power converter, magnetic components occupy a certain degree of the volume and contribute a certain degree of the loss. Therefore, the design and improvement of the magnetic components become very important.

In some application scenarios, such as an application with large current condition, a plurality of interleaved parallel-connected circuits are used to decrease the occurrence of the ripples. In common designs of the magnetic components, in order to guarantee the unsaturation and low loss of the magnetic material, the volume of the magnetic components has to be increased to decrease the magnetic induction in the magnetic core. As a result, it is needed to achieve the balance between high efficiency and high power density.

Accordingly, what is needed is a switching mode power supply and an integrated device of the same to address the above issues.

SUMMARY

An aspect of the present invention is to provide a magnetic core. The magnetic core includes a plurality of magnetic core units each having at least one non-shared magnetic core part that is not shared with the neighboring magnetic core unit, wherein a reluctance of the shared magnetic core part is smaller than the reluctance of a non-shared magnetic core part of the magnetic core units, and directions of a direct current magnetic flux in the shared magnetic core part of the neighboring two magnetic core units are opposite.

Yet another aspect of the present invention is to provide a magnetic component. The magnetic component includes a magnetic core and a plurality of windings. The magnetic core includes a plurality of magnetic core units each having at least one non-shared magnetic core part that is not shared with the neighboring magnetic core unit, wherein a reluctance of the shared magnetic core part is smaller than the reluctance of a non-shared magnetic core part of the magnetic core units, and directions of a direct current magnetic flux in the shared magnetic core part of the neighboring two magnetic core units are opposite. Each of the windings is disposed to be correspondingly wound at the non-shared magnetic core part of the magnetic core unit.

These and other features, aspects, and advantages of the present invention will become better understood with reference to the following description and appended claims.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

The magnetic component in the present disclosure includes a magnetic core and a winding. The magnetic core includes a plurality of magnetic core units. A part of the direct current (DC) magnetic flux ($B_{DC}$) of the magnetic component cancels out due to the same shared magnetic core part shared by the two neighboring magnetic core units. The DC magnetic induction cancellation enhance the saturation performance. Further, the effect of DC bias on magnetic core loss is also reduced. Therefore, the volume of the magnetic core and the whole magnetic component can be reduced. By using different types of windings, the magnetic component can become magnetic apparatus having different functions. For example, when the winding is a transformer winding, the magnetic component is used as a transformer. When the winding is an inductor winding, the magnetic component is used as an inductor. An inductor in a three-phase interleaved buck circuit is used as an example to describe the magnetic component.

Figure 1:
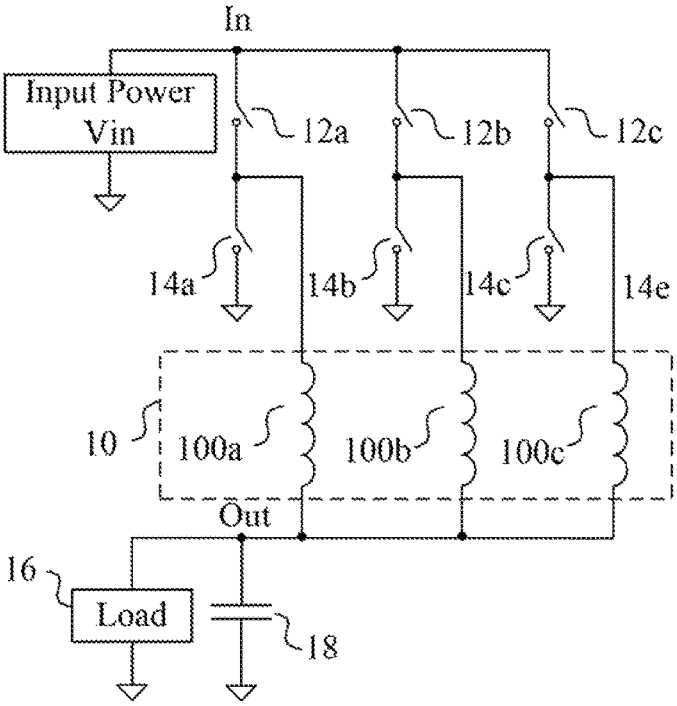
FIG. 1 is a circuit diagram of a multi-phase paralleled power converter in an embodiment of the present invention.

Reference is now made to FIG. 1. FIG. 1 is a circuit diagram of a power converter in an embodiment of the present invention. The direct current to direct current (DC/DC) power converter includes an inductor module 10, a plurality of switches 12*a*, 12*b*, 12*c*, 14*a*, 14*b*, 14*c* and load 16.

The inductor module 10 includes a plurality of inductors 100*a*-100*c*. One terminal of each of the inductors 100*a*-100*c* is electrically connected together to form a multi-phase paralleled output terminal OUT of the DC/DC power converter. As a result, the inductor module 10 is the output inductor corresponding to the multi-phase paralleled output terminal OUT of the DC/DC power converter.

The switches 12*a*-12*c* and the corresponding switches 14*a*-14*c* form a multi-phase paralleled power conversion circuits. The multi-phase paralleled output terminal OUT is the output of the power conversion circuits. In the present embodiment, as illustrated in FIG. 1, each of the inductors 100*a*-100*c* is electrically connected to the corresponding switches 12*a*-12*c* and 14*a*-14*c*. Taking the inductor 100*a* as an example, the inductor 100*a* is electrically connected to the switches 12*a* and 14*a*. The inductors 100*a*-100*c* are further coupled to a multi-phase paralleled input terminal IN through the switches 12*a*-12*c*. In the present embodiment, the multi-phase paralleled input terminal IN receives an input voltage Vin.

The load 16 is electrically connected to the inductor module 10 at the multi-phase paralleled output terminal OUT. In an embodiment, the DC/DC power converter further includes other load components, such as but not limited to the capacitor 18 illustrated in FIG. 1 to stabilize the circuit.

It is appreciated that the disposition of the inductor module 10 in the power converter is merely an example. In other embodiments, the inductor module 10 can be directly electrically connected to the multi-phase paralleled input terminal IN to use as input inductors and are electrically coupled to the multi-phase paralleled output terminal OUT through the switches 12*a*-12*c* and 14*a*-14*c*.

Figure 2:
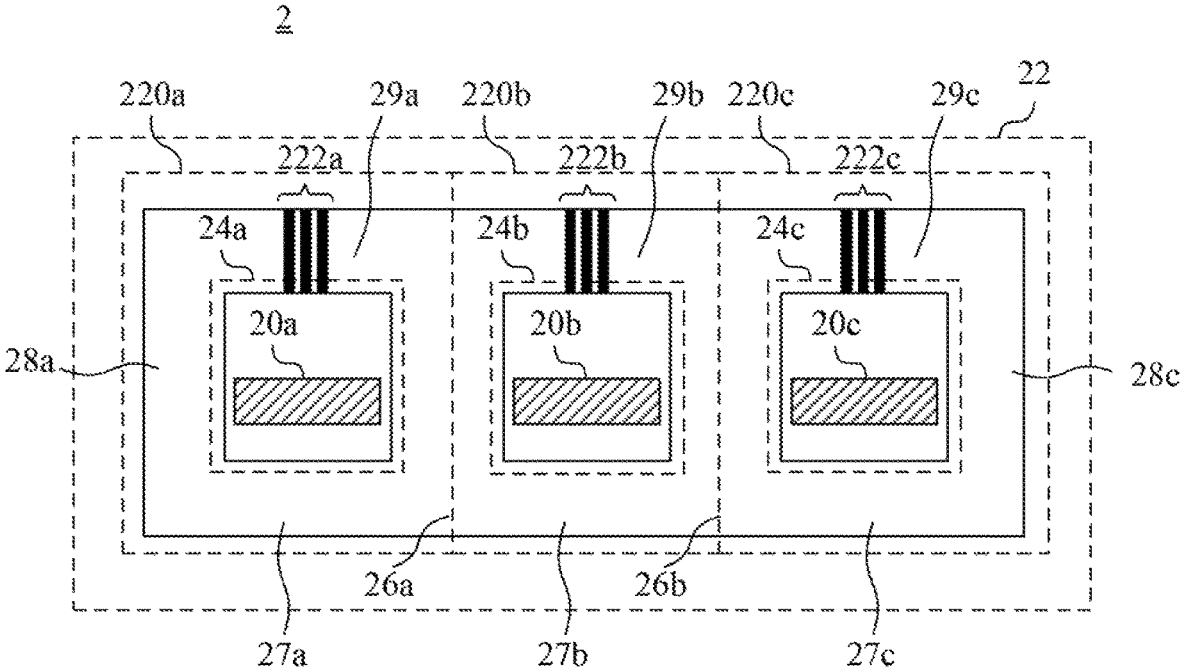
FIG. 2 is a diagram of the structure of a multi-phase inductor used in the multi-phase paralleled power converter in an embodiment of the present invention.

The inductor module 10 can be implemented by a magnetic component 2 illustrated in FIG. 2. Reference now is made to FIG. 2. FIG. 2 is a diagram of the magnetic component 2 used in the inductor module 10 in an embodiment of the present invention. The magnetic component 2 includes a plurality of inductor windings 20*a*, 20*b* end 20*c* and a magnetic core 22. The inductor windings 20*a*-20*c* and the magnetic core 22 are integrated to form the inductors 100*a*-100*c* illustrated in FIG. 1.

The number of the windings 20*a*-20*c* is corresponding to the number of the inductors 100*a*-100*c* in the inductor module 10 illustrated in FIG. 1. In an embodiment, the inductor windings 20*a*-20*c* includes a copper sheet, a litz wire, a PCB winding, a circular conductor, a bunched conductor or a flat wire.

In the present embodiment, the magnetic core 22 includes three magnetic core units 220*a*, 220*b* and 220*c*. The magnetic core units 220*a*-220*c* include the corresponding windows 24*a*, 24*b* and 24*c*. Each of the magnetic core units 220*a*-220*c* has a closed geometrical structure to form one of the windows 24*a*-24*c*. It is appreciated that though there are three windows in the present embodiment, the magnetic core units do not necessarily have the closed geometrical structure to form the windows. The magnetic core units can be an open structure without forming the windows.

As illustrated in FIG. 2, each of the magnetic core units 220*a*-220*c* is a quadrangle formed by four magnetic pillars that have a through hole, in which the through hole forms the window to dispose the inductor windings. The magnetic core unit 220*a* corresponds to the window 24*a*. The magnetic core unit 220*b* corresponds to the window 24*b*. The magnetic core unit 220*c* corresponds to the window 24*c*. Each of the windows 24*a*-24*c* includes at least one of the inductor windings 20*a*-20*c*. For example, the window 24*a* holds the winding 20*a*. The window 24*b* holds the winding 20*b*. The window 24*c* holds the winding 20*c*.

Two of the neighboring magnetic core units have a shared magnetic core part. For example, the magnetic core units 220*a* and 220*b* have a shared magnetic core part 26*a*; the magnetic core units 220*b* and 220*c* have a shared magnetic core part 26*b*. In addition, two of the neighboring magnetic core units further have at least a non-shared magnetic core part. For example, the magnetic core unit 220*a* includes non-shared magnetic core parts 27*a*, 28*a* and 29*a* that are not shared with the magnetic core unit 220*b*. The magnetic core unit 220*b* includes non-shared magnetic core parts 27*b* and 29*b* that are not shared with the magnetic core units 220*a* and 220*c*. The magnetic core unit 220*c* includes non-shared magnetic core parts 27*c*, 28*c* and 29*c* that are not shared with the magnetic core unit 220*b*. In other words, in the present embodiment, the magnetic core units 220*a* and 220*b* have a shared magnetic core part 26*a* and the magnetic core units 220*b* and 220*c* have a shared magnetic core part 26*b*. For the magnetic core unit 220*b*, the magnetic pillars 26*a* and 26*b* are common magnetic pillars shared with other magnetic core units.

In the embodiment illustrated in FIG. 2, the shared magnetic core part 26*a* of the two neighboring magnetic core units 220*a* and 220*b* is a common magnetic pillar, and the non-shared magnetic core parts 27*a*, 29*a* and 28*a* are a first magnetic pillar, a second magnetic pillar and a t bird magnetic pillar respectively. The first magnetic pillar 27*a* and the second magnetic pillar 29*a* are perpendicular to the common magnetic pillar 26*a* that is used as the shared magnetic core part. The third magnetic pillar 28*a* is parallel to the common magnetic pillar. The reluctance of the shared magnetic core part of each of the magnetic core units 220*a*-220*c* is smaller than the reluctance of the non-shared magnetic core part thereof. Taking the magnetic core units 220*a* and 220*b* as an example, the reluctance of the shared magnetic core parts 26*a* is smaller than the reluctance of the non-shared magnetic core parts 27*a*, 28*a* and 29*a* of the magnetic core units 220*a* and 220*b*. Correspondingly, in order to meet the relation of the reluctances of the shared magnetic core part and the non-shared magnetic core part described above, material of different permeability can be used to manufacture the shared magnetic core part and the non-shared magnetic core part respectively. For example, the shared magnetic core part is manufactured by high permeability material and the non-shared magnetic core part is manufactured by low permeability material. The initial permeability of the high permeability material, e.g. ferrite, is larger than 50. The initial permeability of the low permeability material, e.g. powder material, is larger than or equal to 1 and is smaller than or equal to 50. In an embodiment, the shared magnetic core part 26*a* is formed by the material having the initial permeability higher than that of the non-shared magnetic core part to keep the reluctance of the shared magnetic core part 26*a* smaller than that the reluctance of the non-shared magnetic core part.

Besides, in order to meet the relation of the reluctances of the shared magnetic core part and the non-shared magnetic core part described above, the shared magnetic core part and the non-shared magnetic core part can be manufactured by using the material having the same permeability and disposing magnetic sections having lower permeability at the non-shared magnetic core part. The magnetic sections can be a first low permeability structure that has the permeability between 1~50. In other words, though the shared magnetic core part and the non-shared magnetic core part use the material having the same permeability, the requirement that the reluctance of the shared magnetic core part is smaller than the reluctance of the non-shared magnetic core part is still met since the magnetic sections (such as one section or more than one sections of air gaps) having the low permeability are disposed at the non-shared magnetic core part. In other words, under the condition that the air gaps are disposed at the non-shared magnetic core part, the shared magnetic core part and the non-shared magnetic core part can be manufactured by using the material having the same permeability to simplify the manufacturing process of the magnetic cores.

For example, in the embodiment illustrated in FIG. 2, the non-shared magnetic core parts 29*a*, 29*b* and 29*c* of each of the magnetic core units 220*a*-220*c* includes the first low permeability structures 222*a*, 222*b* and 222*c* that has the lowest permeability in the magnetic core units 220*a*-220*c* to meet the requirement of the inductance value and prevent the magnetic core units from saturation. In an embodiment, the permeability of the first low permeability structures 222*a*, 222*b* and 222*c* is smaller than or equal to 50. In one embodiment, the first low permeability structures 222*a*, 222*b* and 222*c* are air gaps. Since the permeability of the shared magnetic core parts is very high and the non-shared magnetic core parts include the first low permeability structures, the reluctance of the shared magnetic core parts far smaller than the reluctance of the non-shared magnetic core parts. Usually the reluctance of the shared magnetic core parts is 1/10 of the reluctance of the non-shared magnetic core parts.

Due to the numerical relation of the reluctance of the shared magnetic core parts and the non-shared magnetic core parts, i.e. the reluctance of the non-shared magnetic core parts is far larger than the reluctance of the shared magnetic core parts, different magnetic core units can share the magnetic pillars without affecting the circuit function. Such a feature is further described in detail in the following paragraphs in the aspect of the magnetic flux distribution.

Figure 3A:
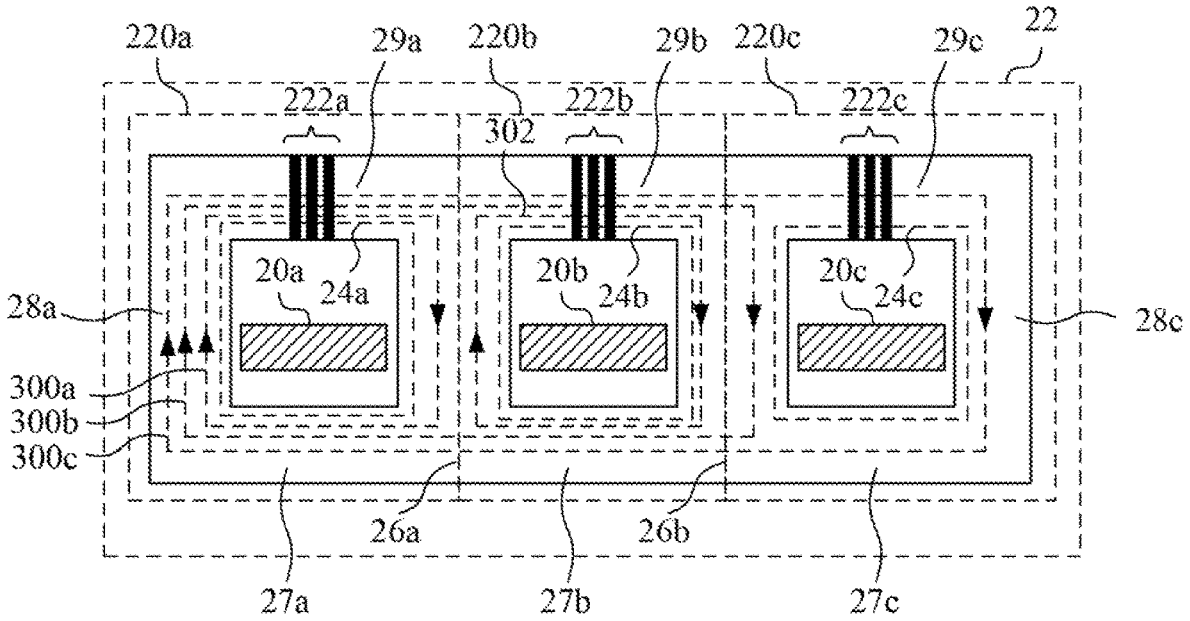
FIG. 3A is a diagram of the multi-phase inductor in FIG. 2 and a part of the magnetic flux distribution therein in an embodiment of the present invention.
Figure 3B:
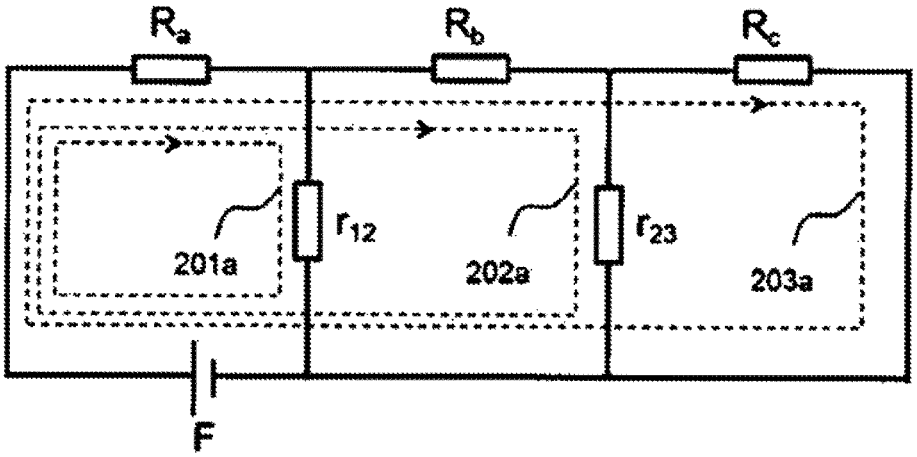
FIG. 3B is a diagram of an equivalent magnetic circuit model of the multi-phase inductor in an embodiment of the present invention.

Reference is now made to FIG. 3A-3B at the same time. FIG. 3A is a diagram of the multi-phase inductor 2 in FIG. 2 and partial magnetic flux therein in an embodiment of the present invention. FIG. 3B is a equivalent model of the multi-phase inductor 2 in FIG. 2 in an embodiment of the present invention.

As illustrated in FIG. 3A, the winding 20*a* is disposed at the window 24*a*, the winding 20*b* is disposed at the window 24*b* and the winding 20*c* is disposed at the window 24*c*. The current flowing through each of the windings 20*a*, 20*b* and 20*c* includes a direct current (DC) component and an alternating current (AC) component, and the DC component of each of the windings 20*a*, 20*b* and 20*c* is supposed to flow into the paper perpendicularly. Taking the winding 20*a* as an example, the DC component generates three magnetic fluxes in the magnetic cores, which are fluxes 300*a*, 300*b* and 300*c* respectively. In order to simplify the discussion, only the magnetic flux distributed in the core is analyzed, and without considering the magnetic fluxes distributed in the air.

The magnetic flux 300*a* only couples with itself and is a leakage flux corresponding to the leakage inductance. The magnetic fluxes 300*b* and 300*c* are mutual magnetic fluxes generated by the winding 20*a* coupling with the other two windings 20*b* and 20*c*, respectively, and the mutual magnetic fluxes are corresponding to respective mutual inductances of the corresponding windings.

As illustrated in the equivalent magnetic circuit model, F is the magnetomotive force (MMF) of the windings 20*a*. Ra is the total reluctance of the non-shared magnetic core part of the magnetic core unit 220*a* and is determined by the first low permeability structure 222*a*. Rb is the total reluctance of the non-shared magnetic core part of the magnetic core unit 220*b* and is determined by the first low permeability structure 222*b*. Rc is the total reluctance of the non-shared magnetic core part of the magnetic core unit 220*c* and is determined by the first low permeability structure 222*c*. r12 is the reluctance of the shared magnetic core part of the magnetic core units 220*a* and 220*b*, and r23 is the reluctance of the shared magnetic core part of the magnetic core units 220*b* and 220*c*. Since the shared magnetic core part includes high permeability material and the non-shared magnetic core part includes the first low permeability structure, the reluctances r12 and r23 of the shared magnetic core part is far smaller than the reluctances Ra, Rb and Rc of the non-shared magnetic core parts. As a result, among the three magnetic fluxes 300*a*, 300*b* and 300*c* generated by the winding 20*a*, the leakage flux 300*a* is large and the mutual fluxes 300*b* and 300*c* are small. Accordingly, though the magnetic core units 220*a* and 220*b* shares one shared magnetic core part 26*a*, the coupling of these two magnetic core units is small. The inductor of the shared magnetic pillar can accomplish the circuit function equivalent to the discrete inductor.

The following paragraph describes the advantage of the shared magnetic core parts included in the neighboring magnetic core units. Reference is now made to FIG. 3A. The largest magnetic flux in the magnetic fluxes generated by a current is defined as the main magnetic flux. As a result, the main magnetic flux generated by the winding 20*a* is 300*a*. Similarly, the main magnetic flux generated by the winding 20*b* is 302. The paths of the magnetic fluxes 300*a* and 302 include a common magnetic pillar, i.e. the shared magnetic core part 26*a*. In the shared magnetic core part 26*a*, the directions of the magnetic fluxes 300*a* and 302 are opposite to cancel out each other. As a result, the magnetic induction B in the shared magnetic core part 26*a* decreases, and the effects of DC bias on core loss decrease and the saturation current increase as well. As a result, the volume of the magnetic core can be decreased. Accordingly, the volume of the inductor illustrated in FIG. 3A can be decreased by letting the neighboring magnetic core units share the shared magnetic core part having the high permeability, in which the shared magnetic core part is disposed at the path of the main magnetic flux of each of the magnetic core units. In order to accomplish a certain inductance and to prevent the magnetic core from saturation, a first low permeability structure is disposed at least a part of the non-shared magnetic core part of each of the magnetic core unit to increase the reluctance of the non-shared magnetic core part.

Figure 4:
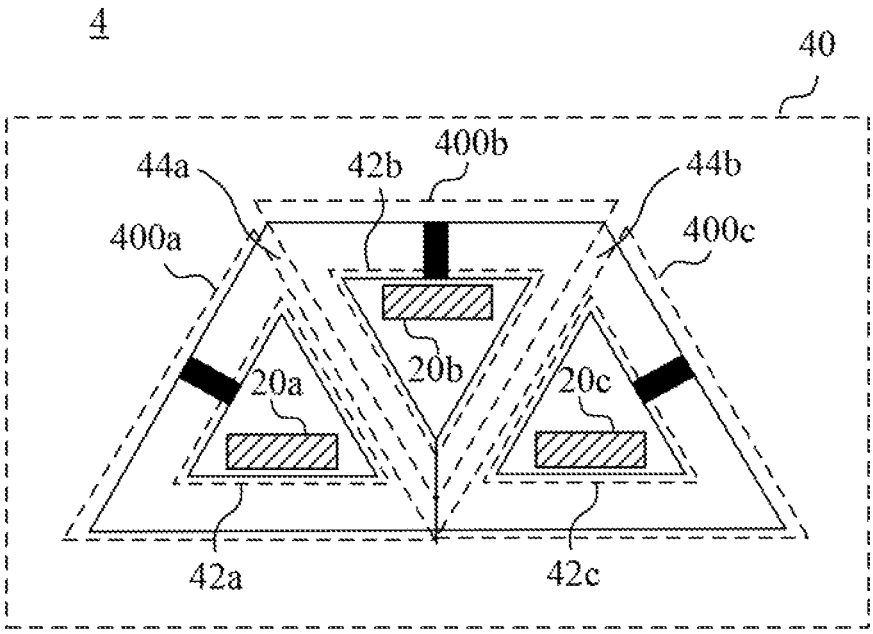
FIG. 4 is a diagram of the magnetic component used in the multi-phase paralleled power converter in an embodiment of the present invention.

Reference is now made to FIG. 4. FIG. 4 is a diagram of the magnetic component 4 in an embodiment of the present invention. The magnetic component 4 includes a plurality of windings 20*a*-20*c* and a magnetic core 40.

In the present embodiment, the magnetic core 40 includes three magnetic core units 400*a*-400*c*. The magnetic core units 400*a*-400*c* include the corresponding windows 42*a*-42*c*. The windings 20*a*-20*c* are disposed in the windows 42*a*-42*c* respectively. The magnetic core units 400*a*-400*c* are presented by a triangle formed by three magnetic pillars. The neighboring two magnetic core units, such as the magnetic core units 400*a* and 400*b*, have a shared magnetic core part 44*a*. The magnetic core units 400*b* and 400*c* have a shared magnetic core part 44*b*. As described in the previous embodiments, the shared magnetic core parts 44*a* and 44*b* can be fabricated by the material having a higher initial permeability as compared to the non-shared magnetic core part and then have a lower reluctance. Of course in the present embodiment, two magnetic pillars of the magnetic core unit 400*b* are both the shared magnetic core parts.

Figure 5:
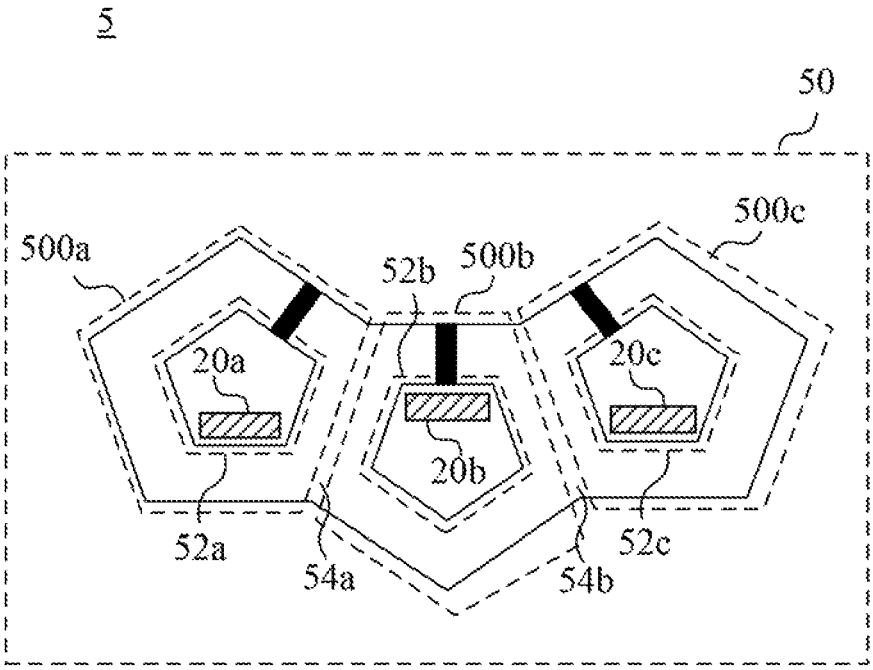
FIG. 5 is a diagram of the magnetic component used in the multi-phase paralleled power converter in an embodiment of the present invention.

Reference is now made to FIG. 5. FIG. 5 is a diagram of the magnetic component 5 in an embodiment of the present invention. The magnetic component 5 includes a plurality of windings 20*a*-20*c* and a magnetic core 50.

In the present embodiment, the magnetic core 50 includes three magnetic core units 500*a*, 500*b* and 500*c* and the corresponding windows 52*a*, 52*b* and 52*c*. The windings 20*a*-20*c* are disposed in the windows 52*a*-52*c* respectively. The magnetic core units 500*a*-500*c* is a pentagon formed by five magnetic pillars. The neighboring two magnetic core units, such as the magnetic core units 500*a* and 500*b*, have a shared magnetic core part 54*a*. The magnetic core units 500*b* and 500*c* have a shared magnetic core part 54*b*. As described in the previous embodiments, the shared magnetic core parts 54*a* and 54*b* can be fabricated by the material having a higher initial permeability as compared to the non-shared magnetic core part and then have a lower reluctance.

In other embodiments the number and the shape of the magnetic core units of the magnetic core can be adjusted according to practical applications and are not limited to the number and the shape described in the above embodiments.

Reference is now made to FIG. 6A-FIG. 6G. FIG. 6A-FIG. 6G are diagrams of a single magnetic core unit 6 respectively in an embodiment of the present invention.

In the present embodiment, the magnetic core unit 6 is a quadrangle that includes four magnetic pillars 60*a*, 60*b*, 60*c* and 60*d*. In an embodiment, the magnetic pillars 60*c* is the shared magnetic core part shared by other magnetic core units (not illustrated), and the magnetic pillars 60*a*, 60*b* and 60*d* are the non-shared magnetic core part of the magnetic core unit. As a result, the magnetic pillars 60*a*, 60*b* and 60*d* may dispose the first low permeability structure (e.g. air gap). The disposition method of the first low permeability structure, such as the number and the position of the first low permeability structure, can be adjusted based on different requirements.

Figure 6A:
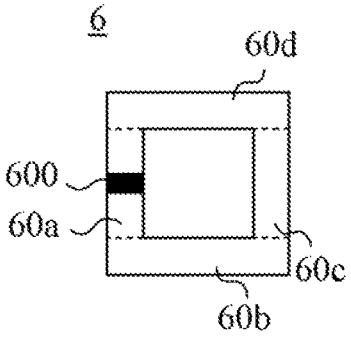
FIG. 6A-FIG. 6G are diagrams of a single magnetic core unit respectively in an embodiment of the present invention.
Figure 6B:
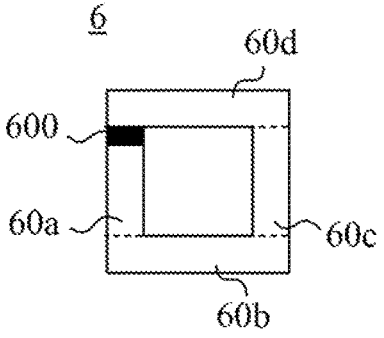
Figure 6C:
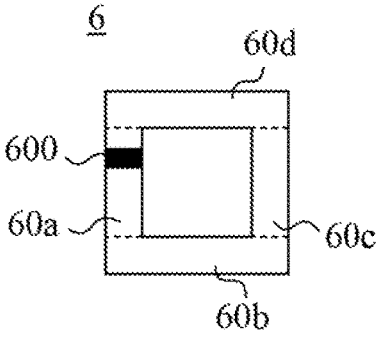

Taking FIG. 6A as an example, the first low permeability structure 600 is an air gap disposed at the center of the magnetic pillar 60*a*. In FIG. 6B, the first low permeability structure 600 is disposed at one terminal of the magnetic pillar 60*a* near to magnetic pillar 60*d*. In FIG. 6C, the first low permeability structure 600 including a single air gap is disposed at a quarter of length of the magnetic pillar 60*a* relative to one terminal of the magnetic pillar 60*a*.

Figure 6D:
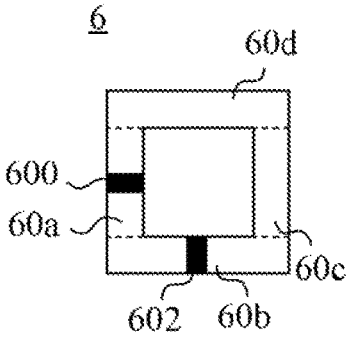
Figure 6E:
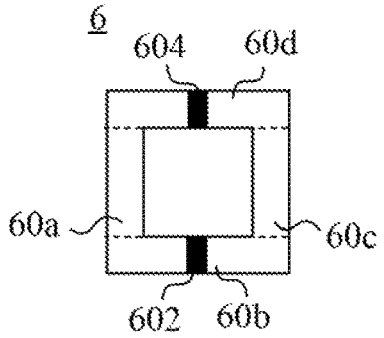
Figure 6F:
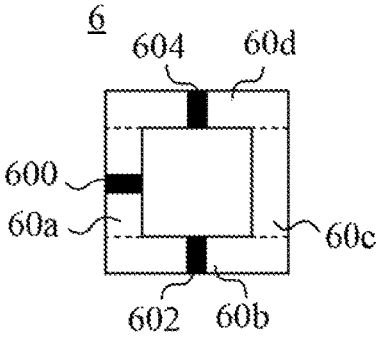

In FIG. 6D, the first low permeability structures 600 and 602 each including a single air gap are disposed at the centers of the magnetic pillars 60*a* and 60*b* respectively. In FIG. 6E, the first low permeability structures 602 and 604 each including a single air gap are disposed at the centers of the magnetic pillars 60*b* and 60*d* respectively. In FIG. 6F, the first low permeability structures 600, 602 and 604 each including a single air gap are disposed at the centers of the magnetic pillars 60*a*, 60*b* and 60*d* respectively.

The first low permeability structures mentioned in the above embodiments are examples of discretely disposing the first low permeability structures on the magnetic core units.

Figure 6G:
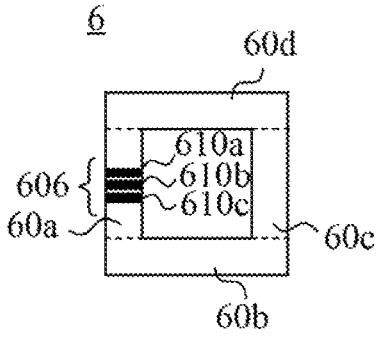

In FIG. 6G, the low permeability structure 606 including three air gaps 610*a*, 610*b* and 610*c* is disposed at the center of the magnetic pillar 60*a*. In the present embodiment, the first low permeability structure is the example of intensively disposing the first low permeability structures on the magnetic core units.

Various combinations of the positions and the numbers of the first low permeability structures and the numbers of the air gap included in the first low permeability structures mentioned above can be used according to different conditions and are not limited thereto. Surely, the air gap in the first low permeability structures can also be stuffed by other material having a low permeability.

Figure 7A:
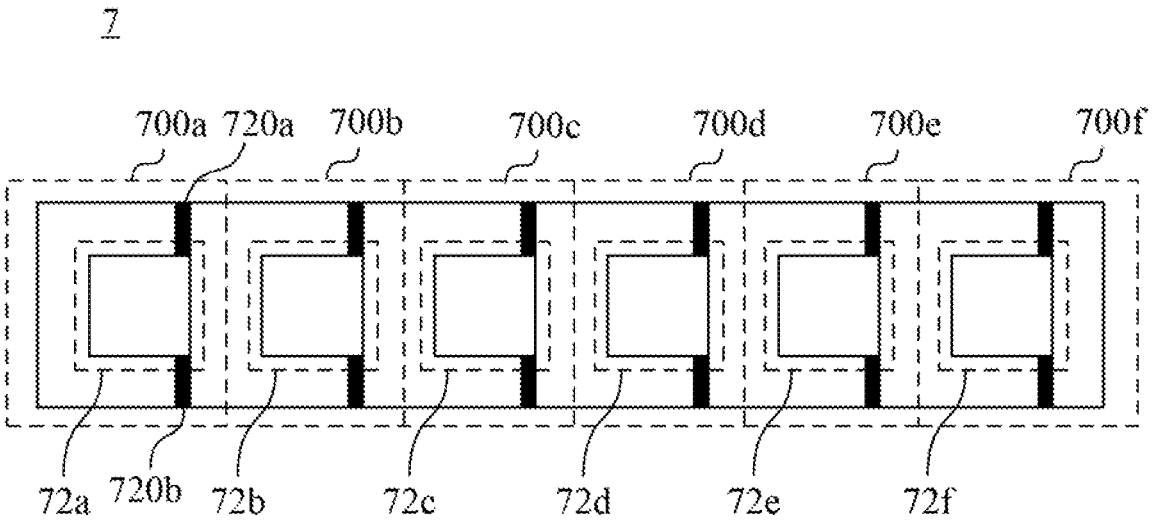
FIG. 7A and FIG. 7B are diagrams of the magnetic core in an embodiment of the present invention.
Figure 7B:
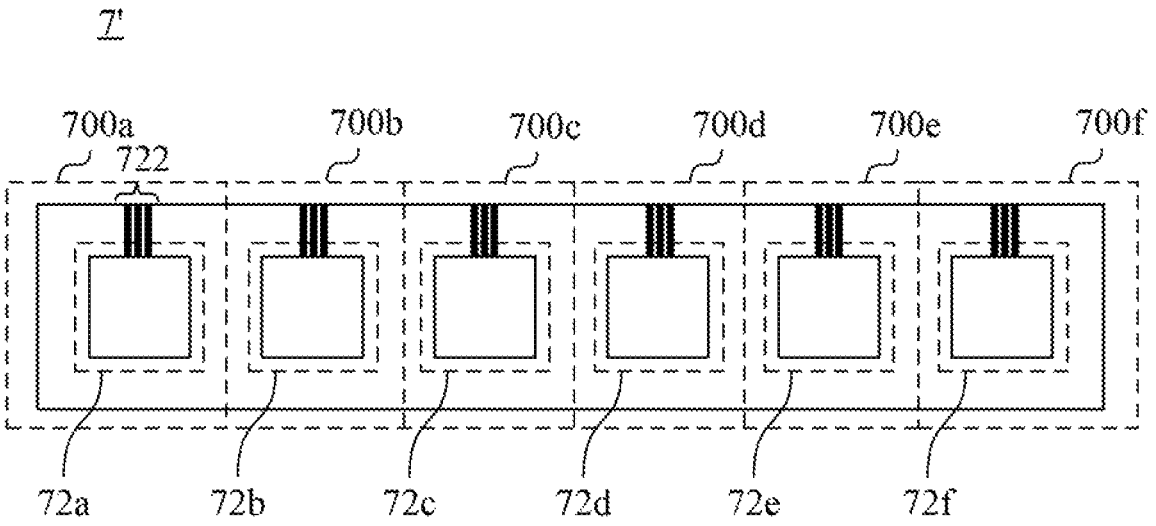

FIG. 7A and FIG. 7B are diagrams of the magnetic core 7 in an embodiment of the present invention. In the present embodiment, the magnetic core 7 includes six magnetic core units 700*a*, 700*b*, 700*c*, 700*d*, 700*e* and 700*f* and corresponding windows 72*a*, 72*b*, 72*c*, 72*d*, 72*e* and 72*f*. The magnetic core units 700*a*-700*f* form a quadrangle. In the present embodiment, the central axes of the windows of the illustrated magnetic core 7 are parallel to each other.

Each of the magnetic core units 700*a*-700*f* includes a first low permeability structure. In FIG. 7, each of the magnetic core units 700*a*-700*f* includes two first low permeability structure, each of which has a single air gap and is disposed at a terminal of a pair of non-shared magnetic core parts perpendicular to the shared magnetic core part, such as the first low permeability structures 720*a* and 720*b* corresponding to the magnetic core unit 700*a*. In FIG. 7B, each of the magnetic core units 700*a*-700*f* includes a plurality of distributed first low permeability structures disposed at the center of the same non-shared magnetic core part perpendicular to the shared magnetic core part, for example, the first low permeability structure 722 of the magnetic core unit 700*a* includes three air gaps distributed at the center of the same non-shared magnetic core part. In other words, the air gaps of each of the magnetic core units in FIG. 7B are disposed at the same side.

Figure 8:
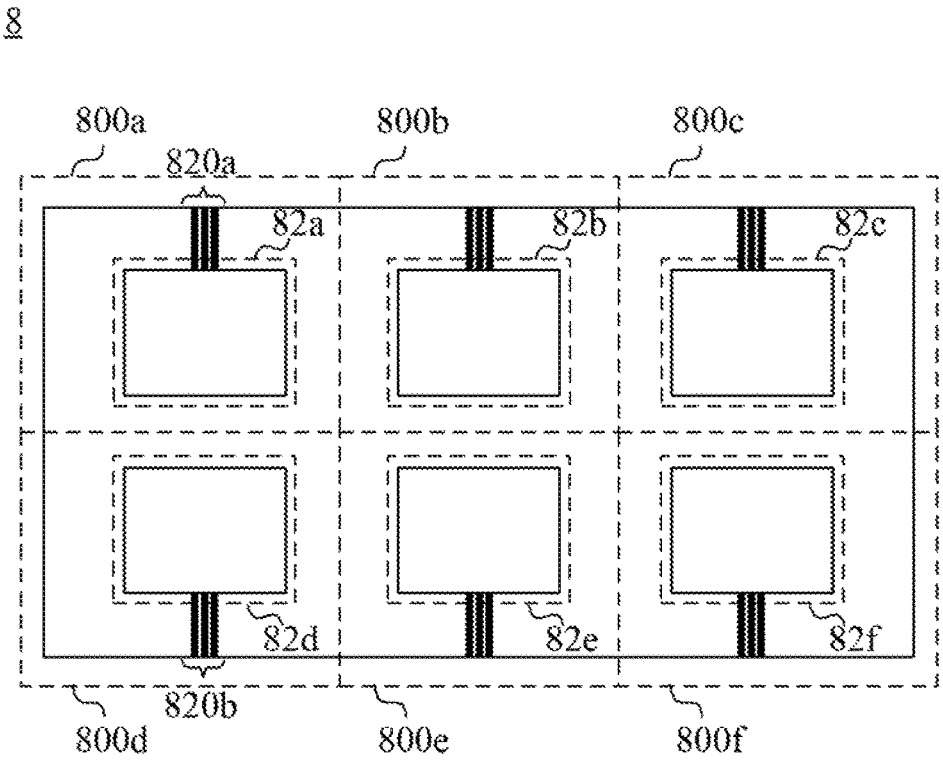
FIG. 8 is a diagram of the magnetic core in an embodiment of the present invention.

FIG. 8 is a diagram of the magnetic core 8 in an embodiment of the present invention. In the present embodiment, the magnetic core 8 includes six magnetic core units 800*a*, 800*b*, 800*c*, 800*d*, 800*e* and 800*f* and corresponding windows 82*a*, 82*b*, 82*c*, 82*d*, 82*e* and 82*f*. The magnetic core units 800*a*-800*f* form a quadrangle. In the present embodiment, each of the magnetic core units 800*a*-800*f* has two or more neighboring magnetic core units connected thereto. Taking the magnetic core unit 800*a* as an example, the magnetic core unit 800*a* has two neighboring magnetic core units 800*b* and 800*d* connected thereto. The magnetic core unit 800*b* has three neighboring magnetic core units 800*a*, 800*c* and 800*e* connected thereto.

Each of the magnetic core units 800*a*-800*c* includes a plurality of first low permeability structures distributed at the center of the same side of the non-shared magnetic core part, such as the first low permeability structure 820*a* corresponding to the magnetic core unit 800*a*. Each of the magnetic core units 800*d*-800*f* includes a plurality of first low permeability structures distributed at the center of the same side of the non-shared magnetic core part, for example, the first low permeability structure 820*b* corresponding to the magnetic core unit 800*d* includes three air gaps disposed at the center of the same non-shared magnetic core part.

As a result, the magnetic core units 800*a*-800*f* of the magnetic core 8 have more shared magnetic core parts to further shrink the size of the magnetic core 8.

Figure 9:
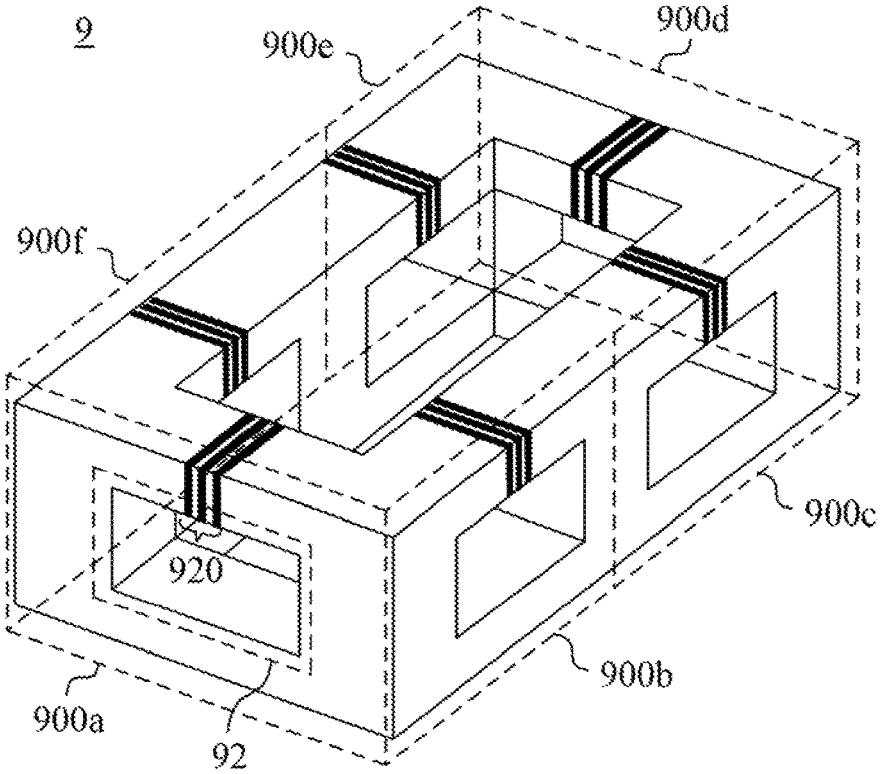
FIG. 9 is a diagram of the magnetic core in an embodiment of the present invention.

FIG. 9 is a diagram of the magnetic core 9 in an embodiment of the present invention. In the present embodiment, the magnetic core 9 includes six magnetic core units 900*a*, 900*b*, 900*c*, 900*d*, 900*e* and 900*f* and corresponding windows, such as the window 92 corresponding to the magnetic core unit 900*a*. The magnetic core units 900*a*-900*f* form a quadrangle. In the present embodiment, each of the magnetic core units 900*a*-900*f* has two neighboring magnetic core units connected thereto to form a cubic. Taking the magnetic core unit 900*a* as an example, the magnetic core unit 900*a* has two neighboring magnetic core units 900*b* and 900*f* connected thereto. The magnetic core unit 900*c* has two neighboring magnetic core units 900*b* and 900*d* connected thereto.

Each of the magnetic core units 900*a*-900*f* includes a plurality of first low permeability structures disposed at the center of the same side of the non-shared magnetic core part, such as the first low permeability structure 920 corresponding to the magnetic core unit 900*a*.

In the magnetic core 9, the central axis of some of the windows of the magnetic core units 900*a*-900*f* are parallel, while the central axis of some of the windows are perpendicular. For example, the central axis of the windows of the magnetic core units 900*a* and 900*b* are perpendicular to each other, and the central axis of the windows of the magnetic core units 900*b* and 900*c* are parallel to each other. As a result, the magnetic core units 900*a*-900*f* of the magnetic core 9 together form a cubic to further shrink the size of the magnetic core 9.

Figure 10:
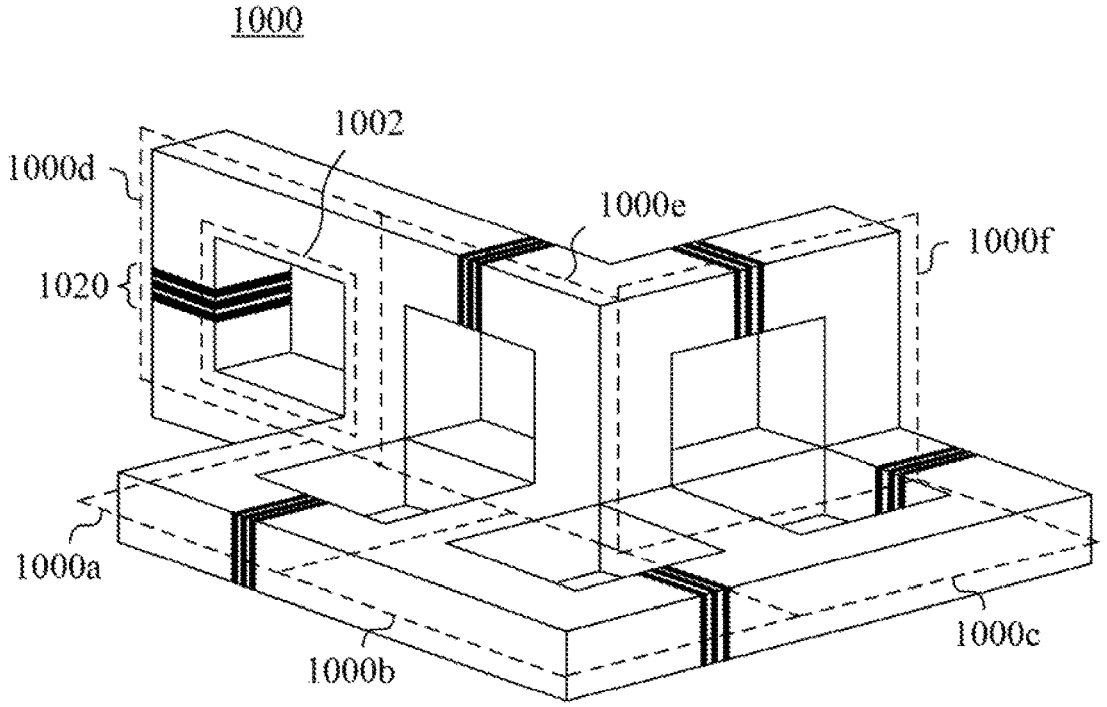
FIG. 10 is a diagram of the magnetic core in an embodiment of the present invention.

FIG. 10 is a diagram of the magnetic core 1000 in an embodiment of the present invention. In the present embodiment, the magnetic core 1000 includes six magnetic core units 1000*a*, 1000*b*, 1000*c*, 1000*d*, 1000*e* and 1000*f* and corresponding windows, such as the window 1002 corresponding to the magnetic core unit 1000*d*. The magnetic core units 1000*a*-1000*f* form a quadrangle. In the present embodiment, the magnetic core units 1000*a*-1000*c* are on the same plane, and the magnetic core unit 1000*b* has the neighboring magnetic core units 1000*a* and 1000*c* connected thereto. The magnetic core units 1000*d*-1000*f* are all on another plane, and the magnetic core unit 1000*e* has the neighboring magnetic core units 1000*b* and 1000*f* connected thereto. The magnetic core units 1000*e* and 1000*f* are respectively adjacent to the magnetic core units 1000*a* and 1000*c*.

The magnetic core units 1000*a*-1000*c* and the magnetic core units 1000*d*-1000*f* are perpendicular to each other. As a result, the central axes of the windows that the magnetic core units 1000*a*-1000*c* and the magnetic core units 1000*d*-1000*f* corresponding to are perpendicular to each other to form an irregular three-dimensional shape.

In the present embodiment, each of the magnetic core units 1000*a*-1000*f* includes a plurality of first low permeability structures disposed at the center of one non-shared magnetic core part, such as the first low permeability structure 1020 corresponding to the magnetic core unit 1000*d* illustrated in FIG. 10.

As a result, the magnetic core units 1000*a*-1000*f* included in the magnetic core 1000 can form an irregular three-dimensional shape according to the practical requirements.

Figure 11:
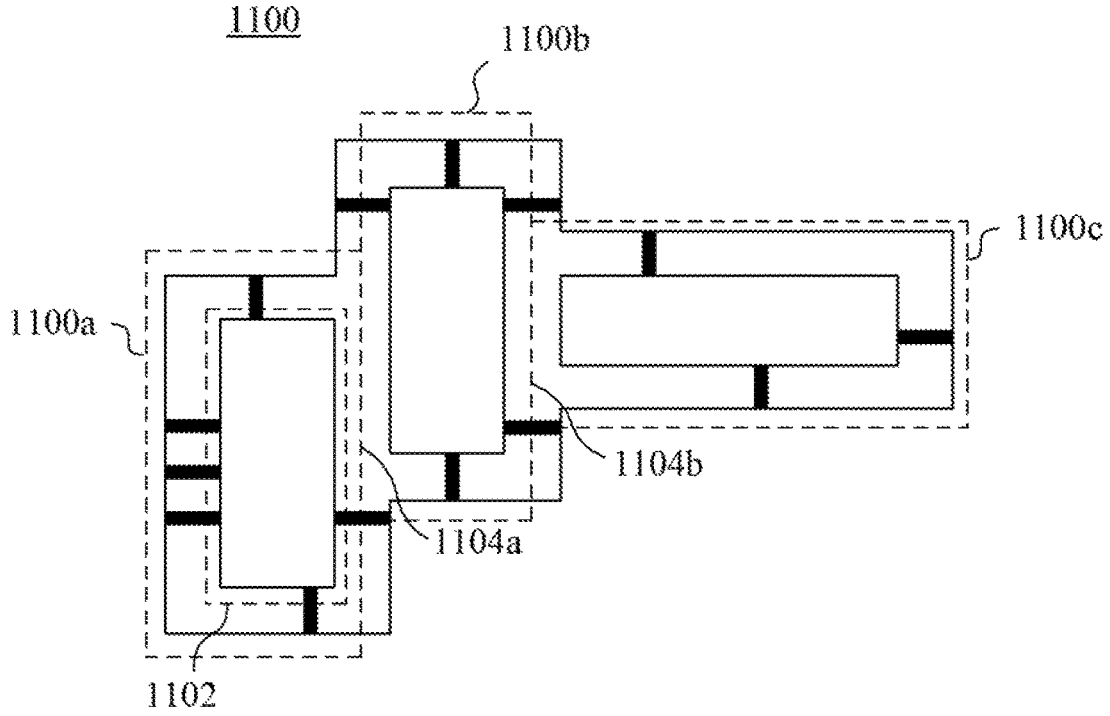
FIG. 11 is a diagram of the magnetic core in an embodiment of the present invention.

FIG. 11 is a diagram of the magnetic core 1100 in an embodiment of the present invention. In the present embodiment, the magnetic core 1100 includes three magnetic core units 1100*a*-1100*c* and corresponding windows, such as the window 1102 corresponding to the magnetic core unit 1100*a*. The magnetic core units 1100*a*-1100*c* is a rectangle. In the present embodiment, for the non-shared magnetic core parts of the magnetic core units 1100*a* and 1100*b*, a shared magnetic core part 1104*a* between the magnetic core units 1100*a* and 1100*b* is partially shared. For the non-shared magnetic core part of the magnetic core unit 1100*b*, a magnetic core part 1104*b* between the magnetic core units 1100*b* and 1100*c* is partially shared. In other words, in the magnetic core 1100 illustrated in FIG. 11, the shared magnetic core parts and the non-shared magnetic core parts are formed at different positions of the same magnetic pillar.

Further, various combination of the numbers and the positions of the first low permeability structures included in the magnetic core units 1100*a*-1100*c* can be used. It is appreciated that though some of the magnetic pillars of the magnetic core units 1100*a*-1100*c* include the shared magnetic core parts 1104*a* and 1104*b*, the first low permeability structures can still be formed on the non-shared magnetic core part of these magnetic pillars.

As a result, the magnetic core units 1100*a*-1100*c* included in the magnetic core 1100 can be formed with a partially shared manner according to the practical requirements.

Figure 12:
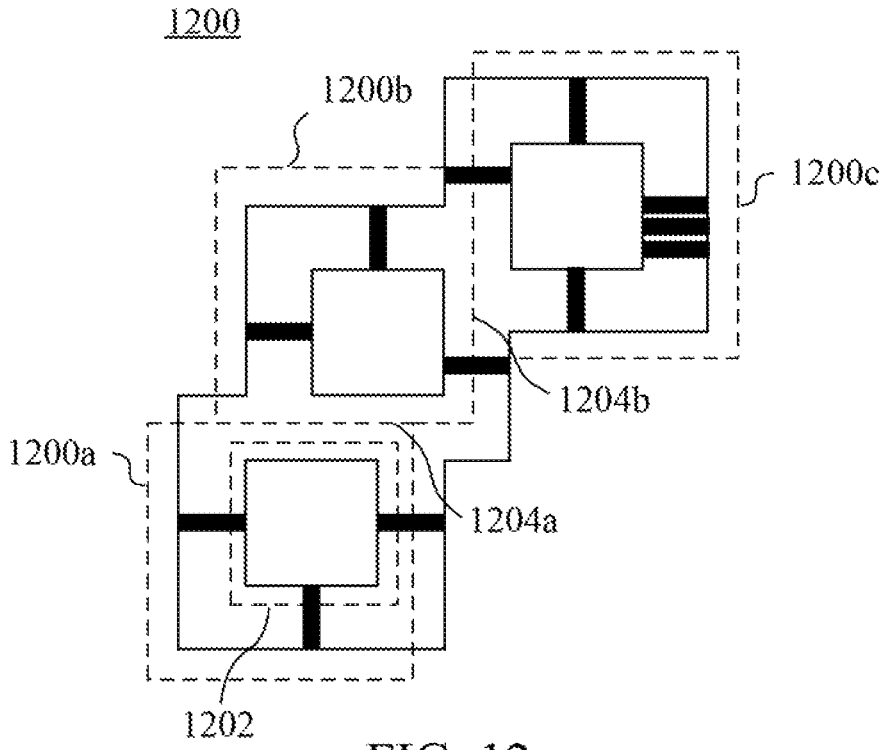
FIG. 12 is a diagram of the magnetic core in an embodiment of the present invention.

FIG. 12 is a diagram of the magnetic core 1200 in an embodiment of the present invention. In the present embodiment, the magnetic core 1200 includes three magnetic core units 1200*a*-1200*c* and corresponding windows, such as the window 1202 corresponding to the magnetic core unit 1200*a*. The magnetic core units 1200*a*-1200*c* is a rectangle. In the present embodiment, for the magnetic pillars of the magnetic core units 1200*a* and 1200*b*, the shared magnetic core part 1204*a* between the magnetic core units 1200*a* and 1200*b* is partially shared. For the magnetic pillars of the magnetic core units 1200*b* and 1200*c*, the shared magnetic core part 1204*b* between the magnetic core units 1200*b* and 1200*c* is partially shared.

Further, various combination of the numbers and the positions of the first low permeability structures included in the magnetic core units 1200*a*-1200*c* can be used. It is appreciated that though some of the magnetic pillars of the magnetic core units 1200*a*-1200*c* includes the shared magnetic core parts 1204*a* and 1204*b*, the first low permeability structures can still be formed on the non-shared part of these magnetic pillars.

As a result, the magnetic core units 1200*a*-1200*c* included in the magnetic core 1200 can be formed with a partially hared manner according to the practical requirements.

Figure 13:
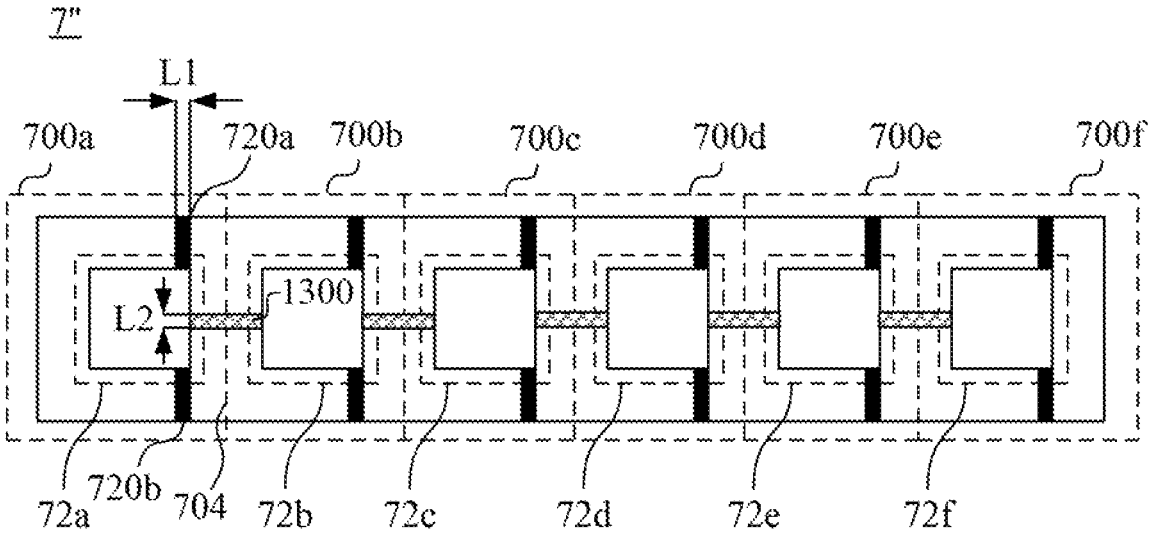
FIG. 13 is a diagram of the magnetic core in an embodiment of the present invention.

FIG. 13 is a diagram of the magnetic core 7" in an embodiment of the present invention.

In the present embodiment, the magnetic core 7" includes six magnetic core units 700*a*, 700*b*, 700*c*, 700*d*, 700*e* and 700*f* and corresponding windows 72*a*, 72*b*, 72*c*, 72*d*, 72*e* and 72*f*. The magnetic core units 700*a*-700*f* is a quadrangle. Each of the magnetic core units 700*a*-700*f* includes two first low permeability structures each having a single air gap and each disposed at a terminal of a pair of non-shared magnetic core parts perpendicular to the shared magnetic core part, such as the first low permeability structures 720*a* and 720*b* corresponding to the magnetic core unit 700*a* that is disposed at the terminal of the two non-shared magnetic core units perpendicular to the shared magnetic core part 704.

However, in the present embodiment, taking the shared magnetic core part 704 of the magnetic core units 700*a* and 700*b* as an example, the shared magnetic core part 704 includes a second low permeability structure 1300. As a result, in an embodiment, the permeability of the first low permeability structure 720*a* of the non-shared magnetic core part is U1 the permeability of the other non-shared magnetic core part of the magnetic core unit 700*a* is U3, U3>U1. The permeability of the second low permeability structure 1300 of the shared magnetic core part is U2, the permeability of the other part of the shared magnetic core part is U4, U4>U2 The cross-sectional area and the length of the non-shared magnetic core part of the magnetic core unit 700*a* are S1 and L1, and the cross-sectional area and the length of the shared magnetic core part 704 are S2 and L2, the reluctance Rm1 of the non-shared magnetic core part would be (2*L1)/(U1*S1) under the condition that U3 is far larger than U1. The reluctance Rm2 of the shared magnetic core part 704 would be L2/(U2*S2) under the condition that U4 is far larger than U2. After the adjustment of the lengths L1 and L2 and the cross-sectional areas S1 and S2, the reluctance Rm2 of the shared magnetic core part 704 can be smaller than the reluctance Rm1 of the non-shared magnetic core part.

Figure 14A:
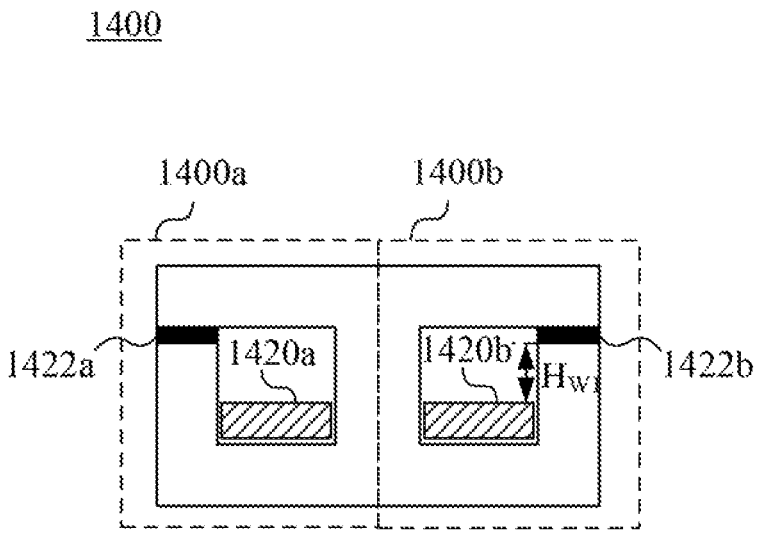
FIG. 14A is a diagram of the magnetic core in an embodiment of the present invention.
Figure 14B:
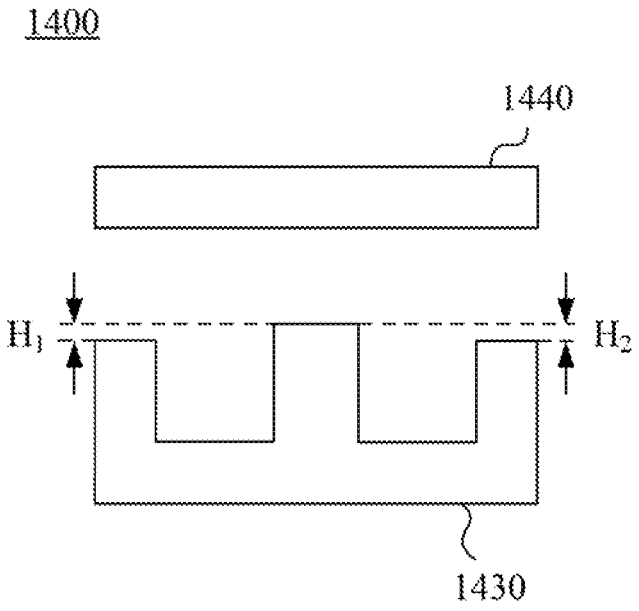
FIG. 14B is a diagram of the manufactured structure of the magnetic core illustrated in FIG. 14A in an embodiment of the present invention.

FIG. 14A is a diagram of the magnetic core 400 in an embodiment of the present invention. FIG. 14B is a diagram of the manufactured structure of the integrated magnetic core 1400 illustrated in FIG. 14A in an embodiment of the present invention.

In the embodiment illustrated in FIG. 14A, the magnetic core 1400 includes two magnetic core units 1400*a*-1400*b* and corresponding windows that further include the corresponding inductor windings 1420*a* and 1420*b*. The magnetic core units 1400*a*-1400*b* include first low permeability structures 1422*a* and 1422*b* respectively. The first low permeability structures 1422*a* and 1422*b* are disposed at the non-shared magnetic core parts parallel to the shared magnetic core part respectively. The inductor windings 1420*a* and 1420*b* are wound at the non-shared magnetic core parts perpendicular to the shared magnetic core part respectively.

In order to manufacture the magnetic core 1400 in FIG. 14A, the implementation is realized by fabricating the magnetic core base 1430 and the magnetic core top cover 1440 illustrated in FIG. 14B respectively. The magnetic core top cover 1440 can be an I-shaped magnetic core and the magnetic core base 1430 can be an E-shaped magnetic core. The magnetic core base 1430 includes a central pillar, two side pillars and a connection part connecting the central pillar and the two side pillars. The central pillar of the E-shaped magnetic core is the shared magnetic core part, and the two side pillars, the connection part connecting the central pillar and the two side pillars and the magnetic core top cover are the non-shared magnetic core part. The first low permeability structures 1422*a* and 1422*b* are disposed at the two side pillars of the E-shaped magnetic core. The inductor windings 1420*a* and 1420*b* are wound at the connection part of the E-shaped magnetic core.

As illustrated in FIG. 14B, the vertical distances of the side pillars of the two sides of the magnetic core base 1430 relative to the magnetic core top cover 1440 are H1 and H2 respectively. In order to keep the inductance value of the two inductors identical to each other, it may be necessary to keep H1=H2. Since the top surfaces of the side pillars and the top surface of the central pillar are not at the same plane, the polishing of the side pillars has to be performed by two steps, which easily results in the inequality between H1 and H2 due to the tolerances of the manufacturing of the magnetic core. As a result, though the magnetic core 1400 illustrated in FIG. 14A and FIG. 14B can guarantee the volume decrease under the high power condition, the manufacturing process has higher requirements.

Figure 15A:
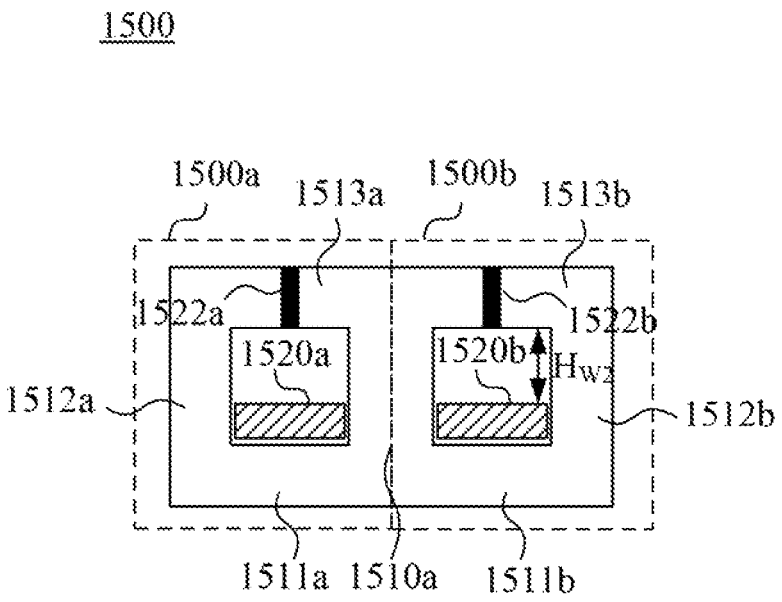
FIG. 15A is a diagram of the magnetic core in an embodiment of the present invention.
Figure 15B:
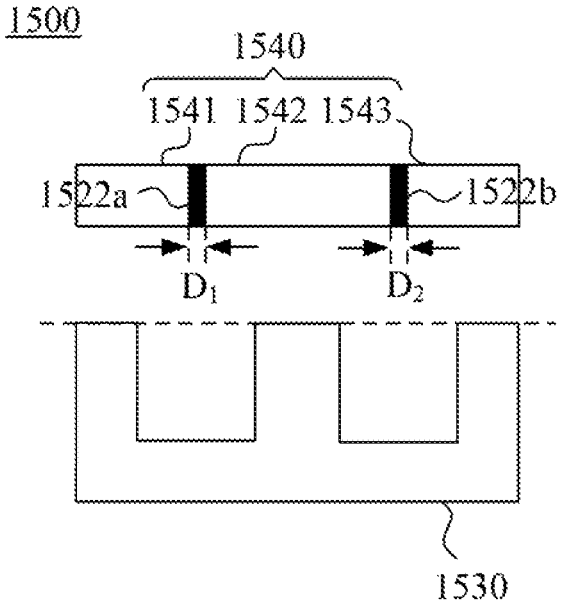
FIG. 15B is a diagram of the manufactured structure of the magnetic core illustrated in FIG. 15A in an embodiment of the present invention.

Reference is now made to FIG. 15A and FIG. 15B. FIG. 15A is a diagram of the magnetic core 1500 in an embodiment of the present invention. FIG. 15B is a diagram of the manufactured structure of the magnetic core 1500 illustrated in FIG. 15A in an embodiment of the present invention.

In the embodiment illustrated in FIG. 15A, the magnetic core 1500 includes two magnetic core units 1500*a*-1500*b* and corresponding windows that further include the corresponding inductor windings 1520*a* and 1520*b*. The magnetic core units 1500*a*-1500*b* include a shared magnetic core part 1510*a* that can be a common magnetic pillar. The magnetic core units 1500*a*-1500*b* further include non-shared magnetic core parts 1511*a*, 1512*a*, 1513*a*, 1511*b*, 1512*b* and 1513*b* that can be formed by a magnetic pillar respectively. The magnetic core units 1500*a*-1500*b* respectively include at least one magnetic material having the permeability ranging from 1~50, such as a first low permeability structure. In the magnetic core 1500 illustrated in FIG. 15A, the magnetic core units 1500*a*-1500*b* include the first low permeability structures 1522*a* and 1522*b* respectively. The first low permeability structures 1522*a* and 1522*b* are disposed at the non-shared magnetic sere parts that are perpendicular to the shared magnetic core part. The inductor windings 1520*a* and 1520*b* are wound at the non-shared magnetic core parts that are perpendicular to the shared magnetic core part.

In order to manufacture the magnetic core in FIG. 15A, the implementation is realized by fabricating the magnetic core base 1530 and the magnetic core top cover 1540 illustrated in FIG. 15B respectively. The magnetic core top cover 1540 can be an I-shaped magnetic core and the magnetic core base 1530 can be an E-shaped magnetic core. The magnetic core base 1530 includes a central pillar two side pillars and a connection part connecting the central pillar and the two side pillars. The central pillar of the E-shaped magnetic core is the shared magnetic core part, and the two side pillars, the connection part connecting the central pillar and the two side pillars and the magnetic core top cover are the non-shared magnetic core part. The first low permeability structures 1522*a* and 1522*b* are disposed at the magnetic core top cover 1540. The inductor windings 1520*a* and 1520*b* are wound at the connection part of the E-shaped magnetic core.

As illustrated in FIG. 15B, the heights of the side pillars and the central pillar of the magnetic core base 1530 should be the same. By polishing the three surfaces at the same time, the inequality of the pillars during the fabrication of the magnetic core can be solved to keep the heights thereof same. Further, the magnetic core top cover 1540 is formed by adhering the magnetic cores 1541, 1542 and 1543 with glue. In order to keep the same inductance value of the two inductors, the widths D1 and D2 of the first low permeability structures 1522*a* and 1522*b* of the magnetic core top cover 1540 needs to be controlled to be identical to each other. In another method, spherical particles that are nonconductive and nonmagnetic insulator and have a diameter of D1 are mixed in the binder to fix the distance between the parts to be adhered in the magnetic core. The consistency of the inductance value of the inductors is increased.

Only if following the principle of sharing the magnetic pillars, the position of the first low permeability structure can be disposed at any place of the non-shared magnetic core part. Therefore, different shapes of the magnetic core can be formed when a plurality of magnetic core units share the magnetic pillar. In FIG. 14B, the first low permeability structures 1422*a* and 1422*b* illustrated in FIG. 14A are disposed at the connection part of two side pillars of the magnetic core base 1430 and the magnetic core top cover 1440 of the magnetic core 1400. In FIG. 15A, the first low permeability structures 1522*a* and 1522*b* are disposed at the magnetic core top cover 1540. Though the two magnetic cores are equivalent from the point of view of the magnetic path, the implementations of the fabrication are different. As a result, the magnetic core 1500 having the first low permeability structures 1522*a* and 1522*b* disposed at the magnetic core top cover 1540 illustrated in FIG. 15A has better control over the accuracy of the inductance value and the greater convenience of the manufacturing process than the magnetic core 1400 having the first low permeability structures 1422*a* and 1422*b* formed at the side pillars illustrated in FIG. 14A.

Besides, for the windings in the window of the magnetic cores, the first low permeability structures bring fringing flux that results in the increase of the eddy loss of the inductor windings. The distance to the first low permeability structures is closer, the loss of the inductor windings is larger. Supposed that between FIG. 14A and FIG. 15A, the sizes are identical except that the position of first low permeability structures of the magnetic core are different. When the vertical distance from the inductor winding 1420*b* to the first low permeability structure 1422*b* in FIG. 14A is Hw1, and the vertical distance from the inductor winding 1520*b* to the first low permeability structure 1522*b* in FIG. 15A is Hw2, it is obvious that Hw2>Hw1. As a result, the eddy loss of the inductor windings in FIG. 15A is smaller.

In the aspect of the expansion of the magnetic core, the magnetic core 1400 illustrated in FIG. 14A can not be expanded to three or more phases of magnetic cores along the horizontal dimension, as the first low permeability structure is disposed at the side pillars of the magnetic core base 1430. The magnetic core 1400 can only be expanded along the direction perpendicular to the horizontal dimension, in which when one phase is added, additional polishing is needed in the manufacturing process. The complexity of the manufacturing of the magnetic core and the difficulty of controlling the consistency of the inductance value are correspondingly increased.

The two shared magnetic cores in FIG. 15A can not only be expanded along the direction vertical to the horizontal dimension, but also can add one or more magnetic core units along the horizontal dimension. It is easy to perform expansion to three or more phases of integrated magnetic cores.

Figure 15C:
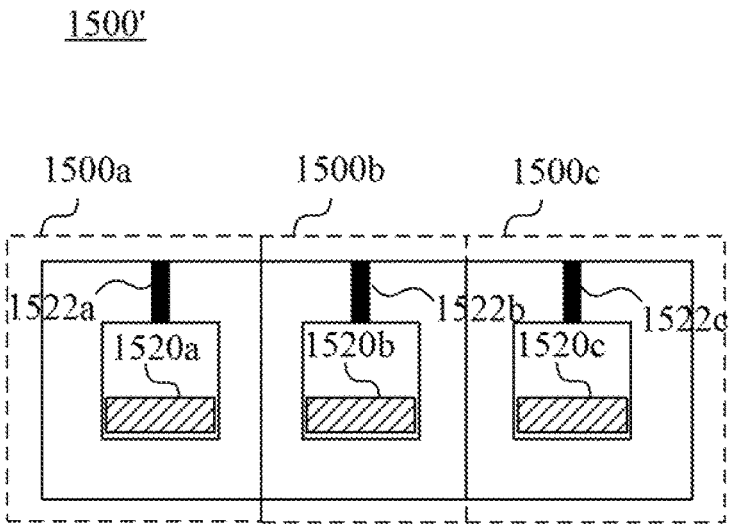
FIG. 15C is a diagram of the magnetic core in an embodiment of the present invention.

FIG. 15C is a diagram of the magnetic core 1500' in an embodiment of the present invention. The magnetic core 1500' is the expansion of the magnetic core 1500 in FIG. 15A and is a three-phase magnetic core that includes the magnetic core units 1500*a*-1500*c* and the corresponding windows and includes the corresponding inductor windings 1520*a*-1520*c*. The magnetic core units 1500*a*-1500*c* includes the first low permeability structures 1522*a*-1522*c* respectively. The expansion along the horizontal dimension is very elastic and convenient. No addition adjustment during the fabrication of the whole magnetic core is needed.

Figure 15D:
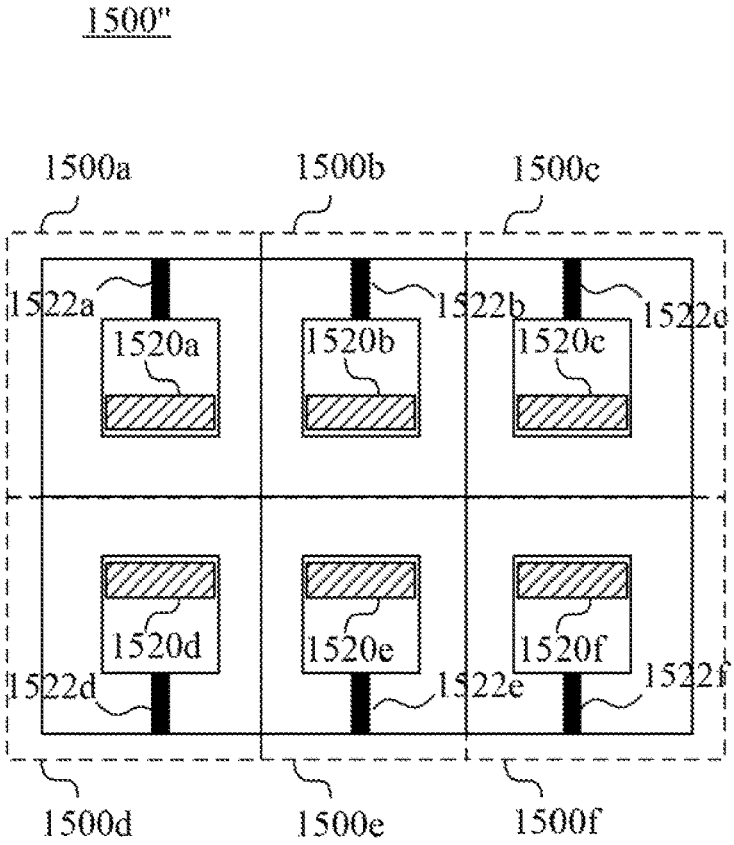
FIG. 15D is a diagram of the magnetic core in an embodiment of the present invention.

FIG. 15D is a diagram of the magnetic core 1500" in an embodiment of the present invention. The magnetic core 1500" is the mirror expansion on the basis of the magnetic core 1500' in FIG. 15C along the direction vertical to the horizontal dimension. The magnetic core 1500" has magnetic core units 1500*a*-1500*f* and the corresponding windows and includes the corresponding inductor windings 1520*a*-1520*f*. The magnetic core units 1500*a*-1500*f* includes the first low permeability structures 1522*a*-1522*f* respectively. Compared to the magnetic core in FIG. 15D with magnetic core in FIG. 5C, the phase number of the core is doubled only one polishing process is added. The fabrication process is relatively easier.

Figure 15E:
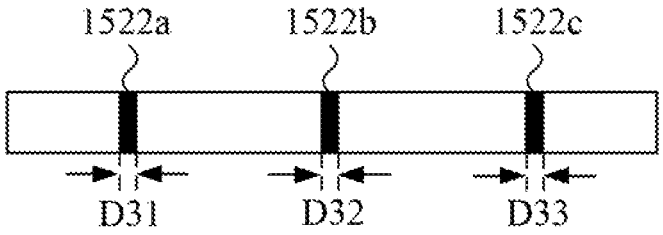
FIG. 15E is a diagram of a top cover in an embodiment of the present invention.

In addition, it needs to point out that when three or more phases magnetic cores are expanded along the x dimension (taking the three-phase core illustrated in FIG. 15C as an example), the top cover is as shown in FIG. 15E. The length of the first low permeability structure 1522*a* of the magnetic core unit 1500*a* is D31 the length of the first low permeability structure 1522*b* of the magnetic core unit 1500*b* is D32 and the length of the first low permeability structure 1522*c* of the magnetic core unit 1500*c* is D33. The conventional design is to keep D31, D32 and D33 as identical as possible during fabrication. Under an ideal condition that the effect of the tolerance is neglected, it can be known from the symmetry of the structure that the inductance value of the magnetic core units 1500*a* and 1500*c* are the same. Since the magnetic core unit 1500*b* is not completely symmetrical to them, the inductance value Lb of the magnetic core unit 1500*b* is not identical with the inductance value La of the magnetic core unit 1500*a*.

Figure 15F:
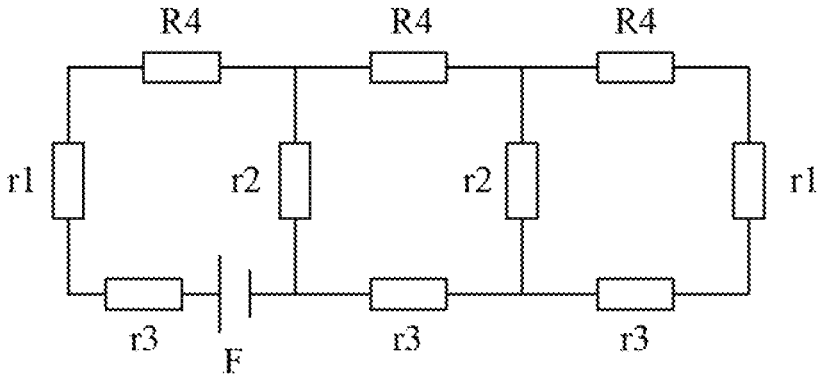
FIG. 15F is a diagram of a magnetic circuit model of the magnetic core unit in an embodiment of the present invention.
Figure 15G:
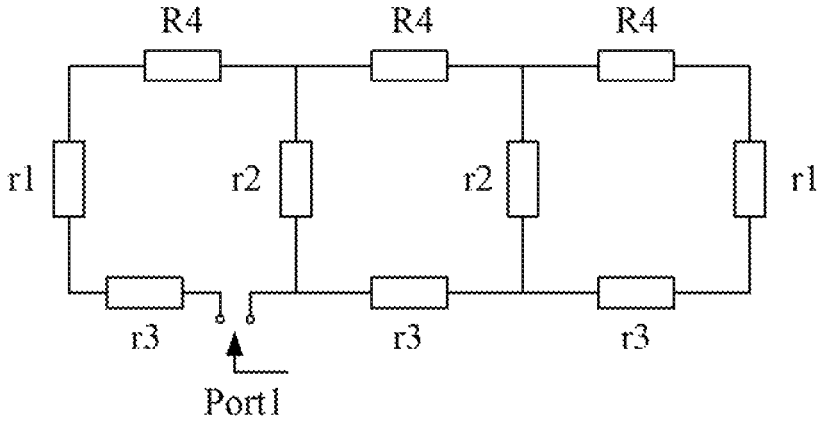
FIG. 15G is a diagram of a magnetic circuit model of the magnetic core unit in an embodiment of the present invention.
Figure 15H:
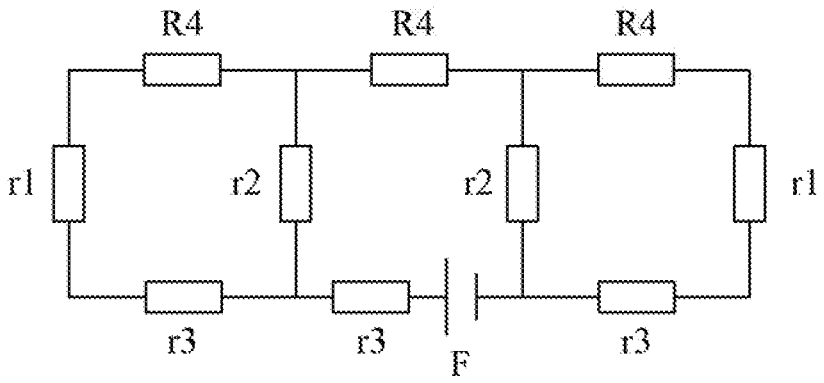
FIG. 15H is a diagram of a magnetic circuit model of the magnetic core unit in an embodiment of the present invention.
Figure 15I:
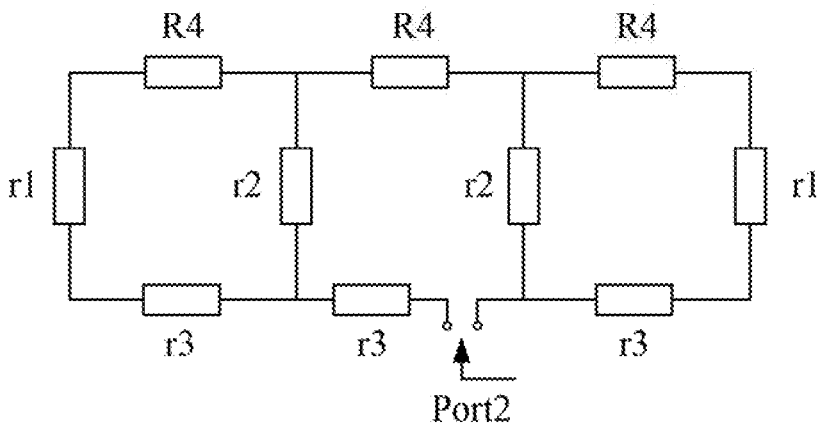
FIG. 15I is a diagram of a magnetic circuit model of the magnetic core unit in an embodiment of the present invention.

FIG. 15F is a diagram of a magnetic circuit model of the magnetic core unit 1500*a* in an embodiment of the present invention. The total reluctance Za is the total impedance from Port 1 (as illustrated in FIG. 15G). Similarly, FIG. 15H is a diagram of a magnetic circuit model of the magnetic core unit 1500*b* in an embodiment of the present invention. The total reluctance Zb is the total impedance from Port 2 (as illustrated in FIG. 15I). According to the relation of the parallel and serial connection of the magnetic path, Za is larger than Zb. The inductance value of the magnetic core unit is inversely proportional to the total reluctance of the magnetic path. As a result, La<Lb, and Lb=(1+α)*La. Normally, the range of α is 0.1%~10%. In the actual inductor specification, the inductors having the same size have an inductance bias of 10%. As a result, in common situations, the bias of the inductance value La and Lb is acceptable. However, for the multi-phase inductors connected in parallel and the inductors having higher requirement of the control of the inductance accuracy, the bias of the inductance needs to be modified. The practical method is to design the length D32 of the first low permeability structure 1522*b* of the magnetic core unit 1500*b* to be (1+α) times of the length D31 of the first low permeability structure 1522*a* of the magnetic core unit 1500*a*. As a result, in the embodiment of the magnetic core 1500' in FIG. 15C, the reluctance of the first low permeability structure 1522*b* of the magnetic core unit 1500*b* that has two neighboring magnetic core units is larger than the reluctance of the first low permeability structures 1522*a* and 1522*c* of the magnetic core units 1500*a* and 1500*c* respectively that each of them has only one neighboring magnetic core unit. So on and so forth, in order to guarantee the balance of the inductance with the magnetic core units having less neighboring magnetic core units and the magnetic core units having more neighboring magnetic core units, the reluctance of the first low permeability structures in the magnetic core units having more neighboring magnetic core units may be designed to be larger than the reluctance of the first low permeability structures in the magnetic core units having less neighboring magnetic core units. For example, a length of air gap (i.e. first low permeability structure 1522*b* in FIG. 15C) of magnetic core unit 1500*b* may be made longer than each of the lengths of air gaps (i.e. first low permeability structures 1522*a* and 1522*c*) of magnetic core unit 1500*a* and 1500*c*, but the disclosure is not limited thereto.

Surely, in other embodiments, the condition that the reluctance of the first low permeability structures in one of the magnetic core units is larger than the reluctance of the first low permeability structures in another one of the magnetic core units can be realized when the permeability of the material of the first low permeability structures in one of the magnetic core units is smaller than the permeability of the material of the first low permeability structures in another one of the magnetic core units.

The advantage of the present disclosure is to shrink the size of the multiple of integrated inductors by using the design of the magnetic core.

The implementation of the inductor windings of multi-phase integrated inductor is described in the following paragraphs.

Figure 16:
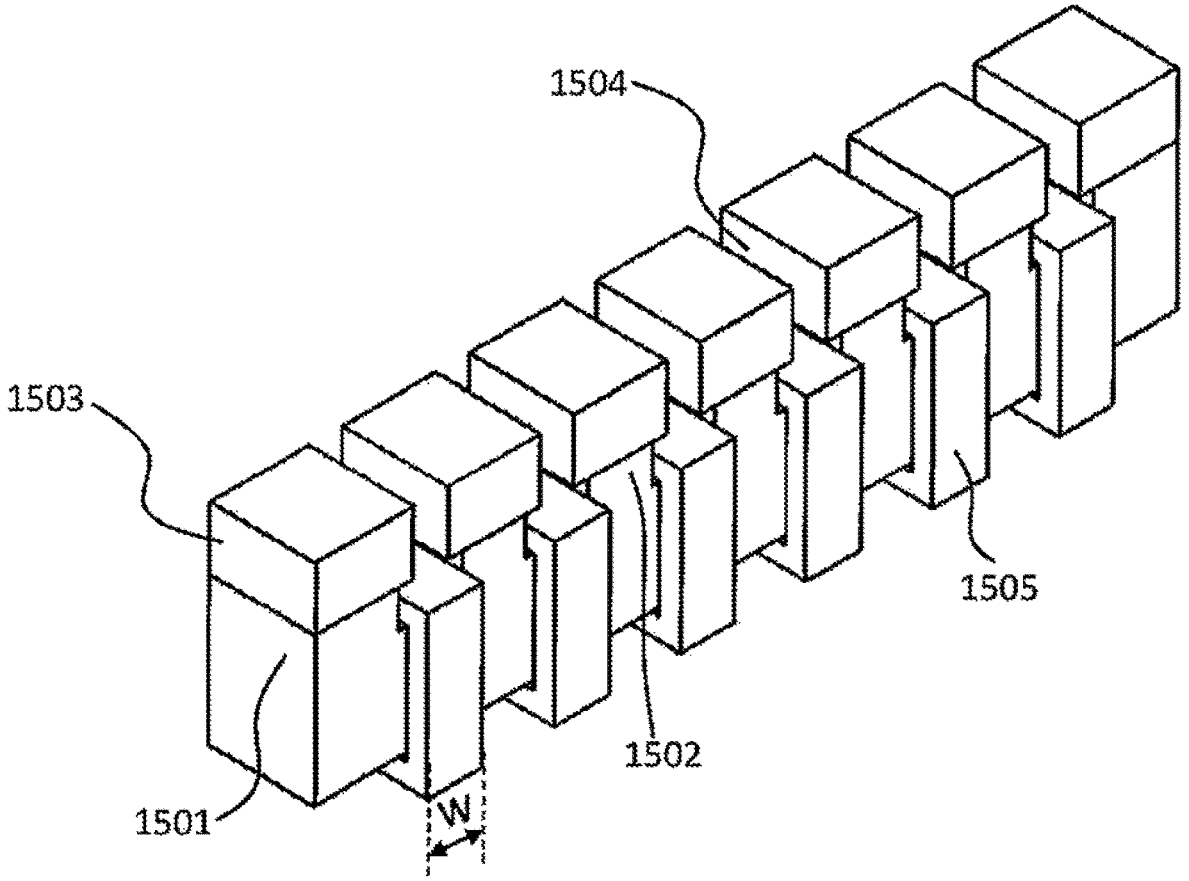
FIG. 16 is a structure of a six-phase integrated inductor in an embodiment of the present invention.

Reference is now made to FIG. 16. FIG. 16 is a diagram of a six-phase integrated inductor in an embodiment of the present invention. The integrated inductor includes an integrated magnetic core and inductor windings. The structure of the six-phase integrated inductor is similar to the magnetic core illustrated in FIG. 7B and includes six magnetic core units arranged along the same direction. The neighboring two magnetic core units share the shared magnetic core part 1502 that has a high permeability. The first low permeability structures 1504 are air gaps and are disposed at the non-shared magnetic core part perpendicular to the shared magnetic core part 1502 and all air gaps are at the same side of the magnetic core. Each of the windows of the integrated magnetic core further includes a corresponding inductor winding 1505. Each of the inductor windings 1505 is wound at the non-shared magnetic core part of the corresponding magnetic core unit that has no air gap thereon.

The magnetic core of the integrated inductor can be formed by an I-shaped magnetic core top cover 1503 and a magnetic core base 1501. A plurality of air gaps are disposed at the I-shaped magnetic core top cover to form the first low permeability structure 1504. The magnetic core base 1501 includes a substrate and seven magnetic pillars thereon, wherein two of them are non-shared magnetic core part and five of them are shared magnetic core part. In an embodiment, the magnetic core base 1501 can be formed by six U-shaped magnetic cores. Each of the U-shaped magnetic core has two magnetic pillars and a connection part connecting the two magnetic pillars. In these six U-shaped magnet cores, the outer side pillar of the first magnetic core, the outer side pillar of the last magnetic core and the connection part of each U-shaped magnet core are non-shared magnetic core parts. The other magnetic pillars of the six U-shaped magnet cores form the shared magnetic core parts. In other embodiments, the magnetic core base 1501 can be formed by combining three E-shaped magnetic cores or by combining U-shaped and E-shaped magnetic cores.

The integrated inductor can be disposed at a multi-phase paralleled input end or a multi-phase paralleled output end of a power transformer. The current flowing through the windings of the integrated inductor includes a DC component and an AC component, wherein the DC component has the same current direction and the AC component has the predetermined phase difference.

Figure 17:
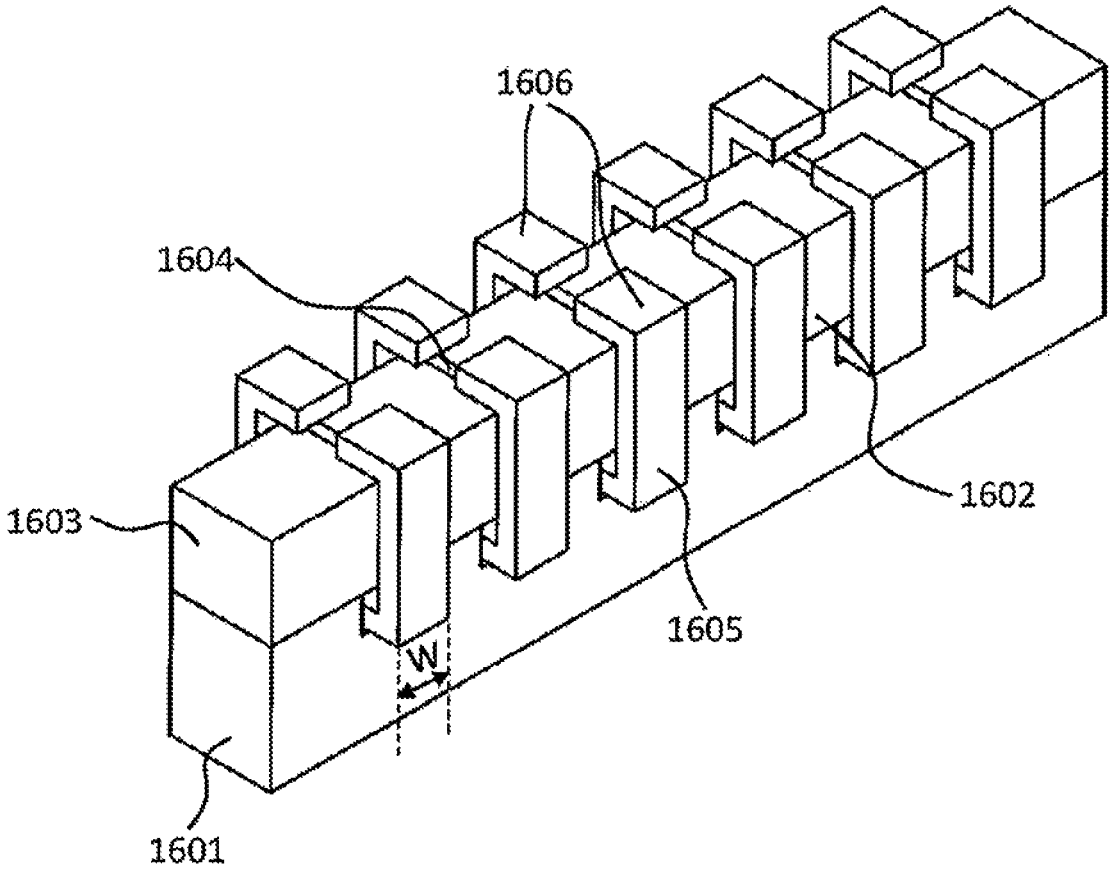
FIG. 17 is a structure of a six-phase integrated inductor in another embodiment of the present invention.

Reference is now made to FIG. 17. FIG. 17 is a diagram of a six-phase integrated inductor in another embodiment of the present invention. The integrated inductor includes an integrated magnetic core and inductor windings. Similar to the six-phase integrated inductor illustrated in FIG. 16, the integrated inductor includes an I-shaped magnetic core top cover 1603 and a magnetic core base 1601. The magnetic core base 1601 includes two non-shared magnetic core parts and five shared magnetic core parts. A plurality of air gaps are disposed at the I-shaped magnetic core top cover 1603 and used as the first low permeability structure 1604. The difference between the integrated inductor in FIG. 16 and FIG. 17 is that: in FIG. 17, each of the inductor windings 1605 is wound at the magnetic core top cover 1603 that has the air gaps. Comparing to the embodiment in FIG. 16, the present embodiment can decrease the leakage magnetic flux of each of the magnetic core units to improve the resistance to the interference, the performance of electromagnetic compatibility and decrease the magnetic coupling between each of the magnetic core units.

Figure 18:
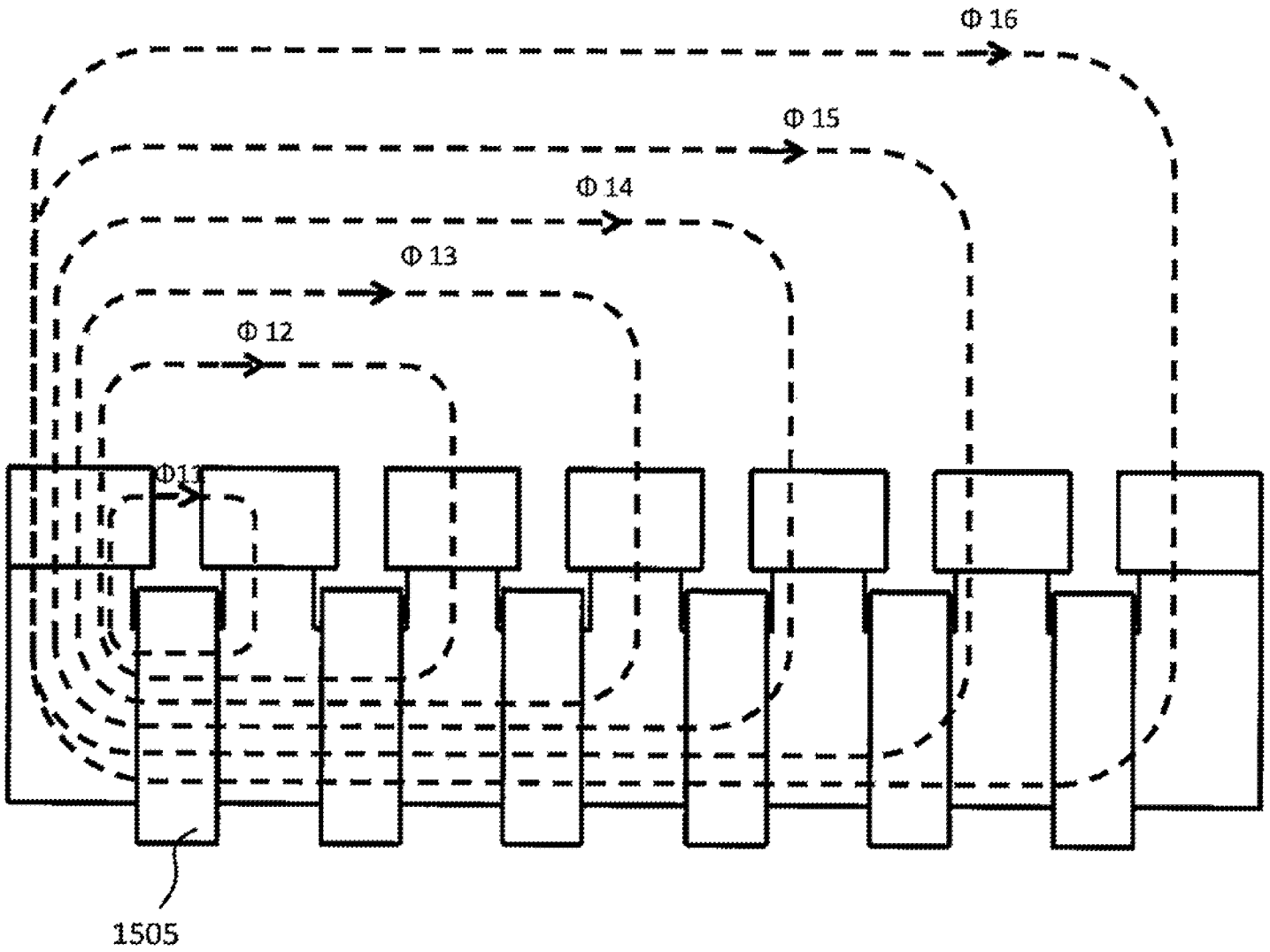
FIG. 18 is a diagram of partial magnetic flux distribution of the six-phase integrated inductor in FIG. 16 in an embodiment of the present invention.

Reference is now made to FIG. 18. FIG. 18 is a diagram of magnetic flux distribution of the first phase inductor windings 1505 of the six-phase integrated inductor after taking the mutual magnetic flux diffusing in the air into consideration. As illustrated in FIG. 16, the fluxes generated by the inductor winding 1505 can be divided into six parts, in which Φ11 is the leakage magnetic flux that only couples to the inductor winding 1505 itself that corresponds to the leakage inductance. Φ12, Φ13, Φ14, Φ15 and Φ16 are the mutual magnetic fluxes between the inductor winding 1505 and other inductor windings and correspond to the mutual inductances of the corresponding inductor windings (please refer to FIG. 3A, in which the mutual magnetic fluxes in the core are very small according to the previous analysis and are ignored due to the simplification). Though the shared magnetic core part of the neighboring magnetic core units are the magnetic pillars having high permeability, the mutual magnetic fluxes are still large such that the magnetic coupling cannot be ignored since the air gaps of each of the magnetic core units are not surrounded by the inductor windings. Especially under the high frequency condition, when the inductor volume is small and the distance between the magnetic core units having different phases is close, the coupling coefficient of the neighboring two magnetic core units can reach the range of 0.2-0.5. For the structure illustrated in FIG. 17, since the air gaps of each of the magnetic core units are surrounded by the inductor windings, the leakage flux is smaller. The coupling coefficient can be decreased to the range of 0-0.15, such as 0.12, 0.10, 0.08, 0.06, etc, and have less influence on the circuit. The performance is identical to the discrete inductor.

Figure 19:
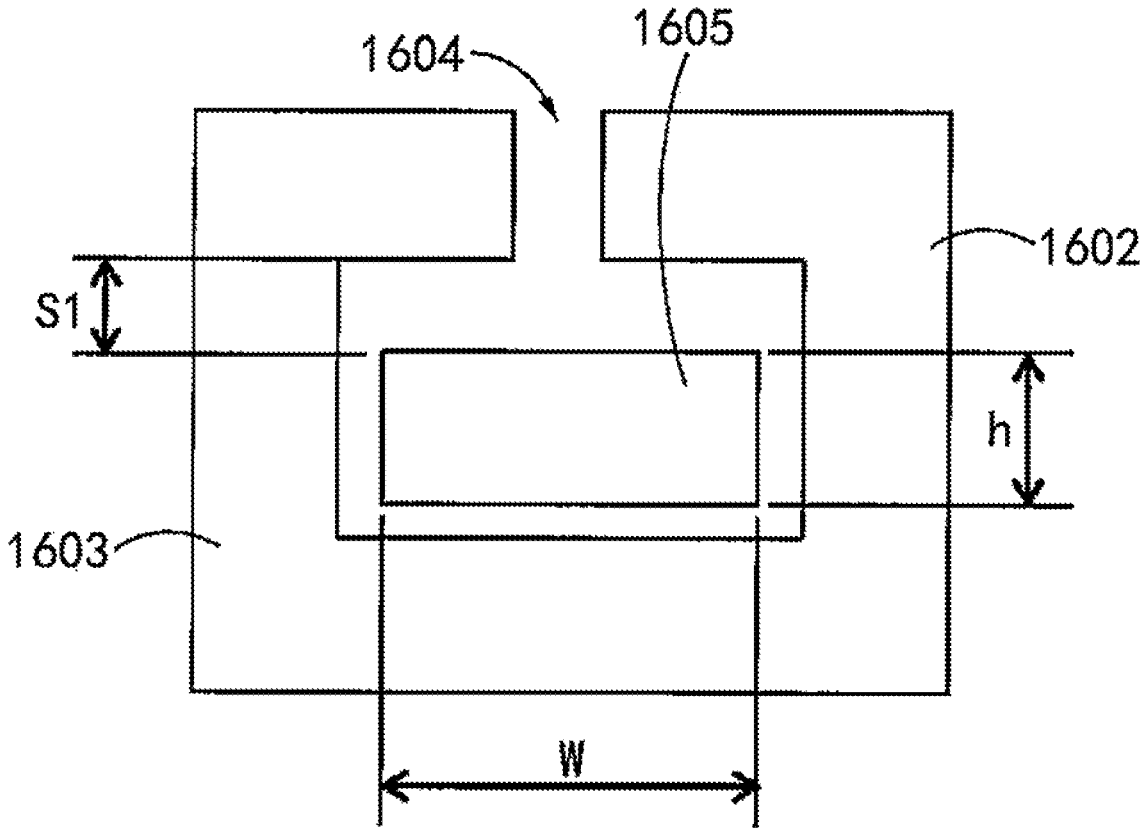
FIG. 19 is a diagram illustrating the structure of an inductor winding and the magnetic core unit of the six-phase integrated inductor illustrated in FIG. 16 in an embodiment of the present invention.

Reference is now made to FIG. 19. FIG. 19 illustrates the structure of an inductor winding and the magnetic core unit of the six-phase integrated inductor illustrated in FIG. 16. In a six-phase integrated inductor, such as the six-phase integrated inductor in FIG. 16 (FIG. 17), the inductor winding 1605 may be flat wires. The cross-sectional surface of the flat wires is rectangular, a width of the flat wires is w, and a thickness of the flat wires is h, w>h. As illustrated in FIG. 19, the advantage of using flat wires to form the inductor winding 1605 is that after the conductor is bent to form the inductor winding, two pads 1606 (illustrated in FIG. 17) can be formed directly and can be welded to the PCB directly.

In the six-phase integrated inductors in FIG. 16 and FIG. 17, the two pads of the inductor winding is bent inward of the inductor. In another embodiment, the inductor winding pads can be bent outward as well. When the inductor winding surrounds the air gaps (illustrated in FIG. 17), the fringing flux of the air gaps can introduce additional loss on the inductor winding. Three methods are used to decrease such a loss in the present embodiment:

Firstly, the direction of the width W of the inductor winding and the first low permeability structure, i.e. the magnetic pillar that the air gaps are disposed, are kept parallel. Since the high frequency current distributes on the conductor surface close to the air gaps, the conduction area of the high frequency current increases and the loss decreases when the plane that the width of the conductor is located faces the first low permeability structure.

Secondly, a suitable distance s1 is kept between the inductor winding and the first low permeability structure, i.e. the air gaps, as illustrated in FIG. 19. For example, the distance s1 and the width w of the inductor winding satisfy the condition of s1>w/5. Generally, under such a condition, the loss generated by the fringing flux of the air gaps can be ignored.

Figure 20:
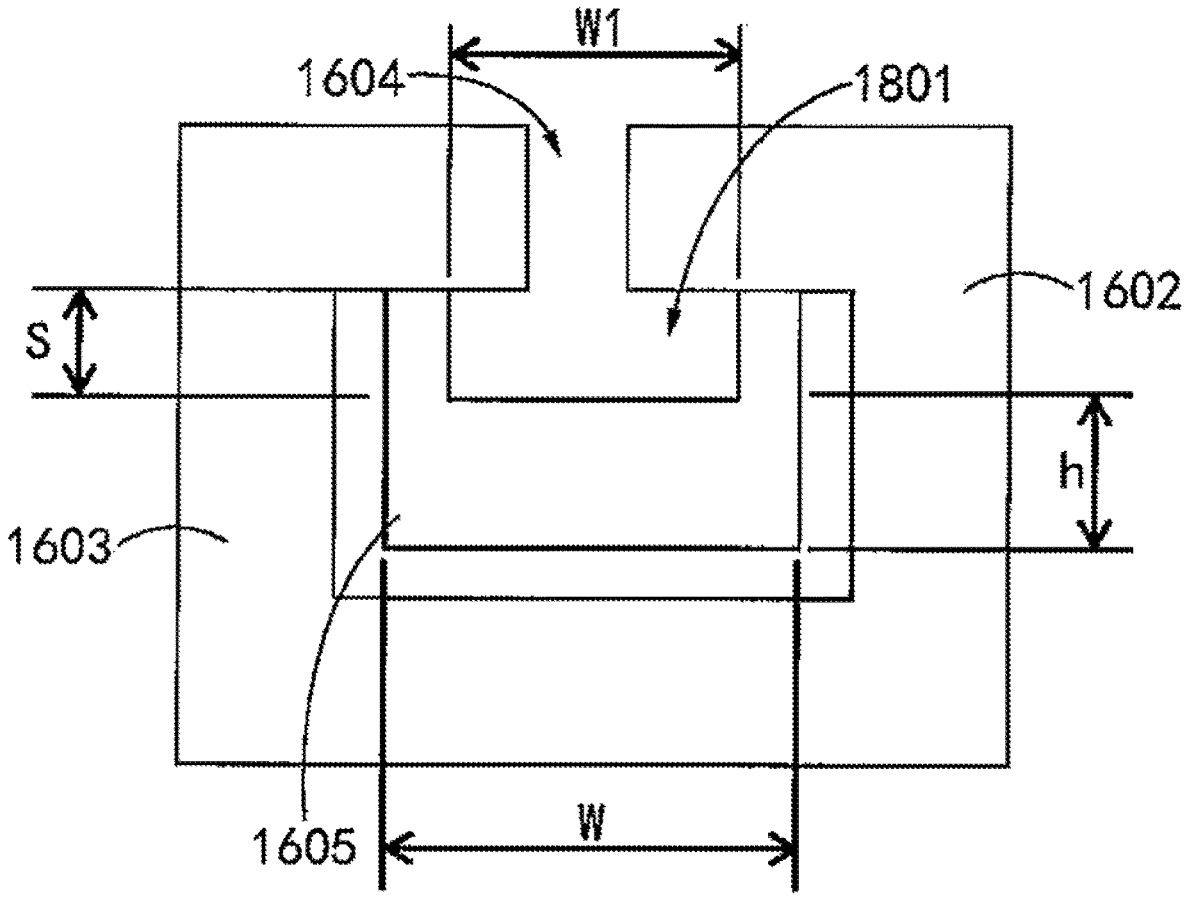
FIG. 20 is a diagram illustrating the structure of an inductor winding and the magnetic core unit of the six-phase integrated inductor illustrated in FIG. 16 in another embodiment of the present invention.
Figure 21:
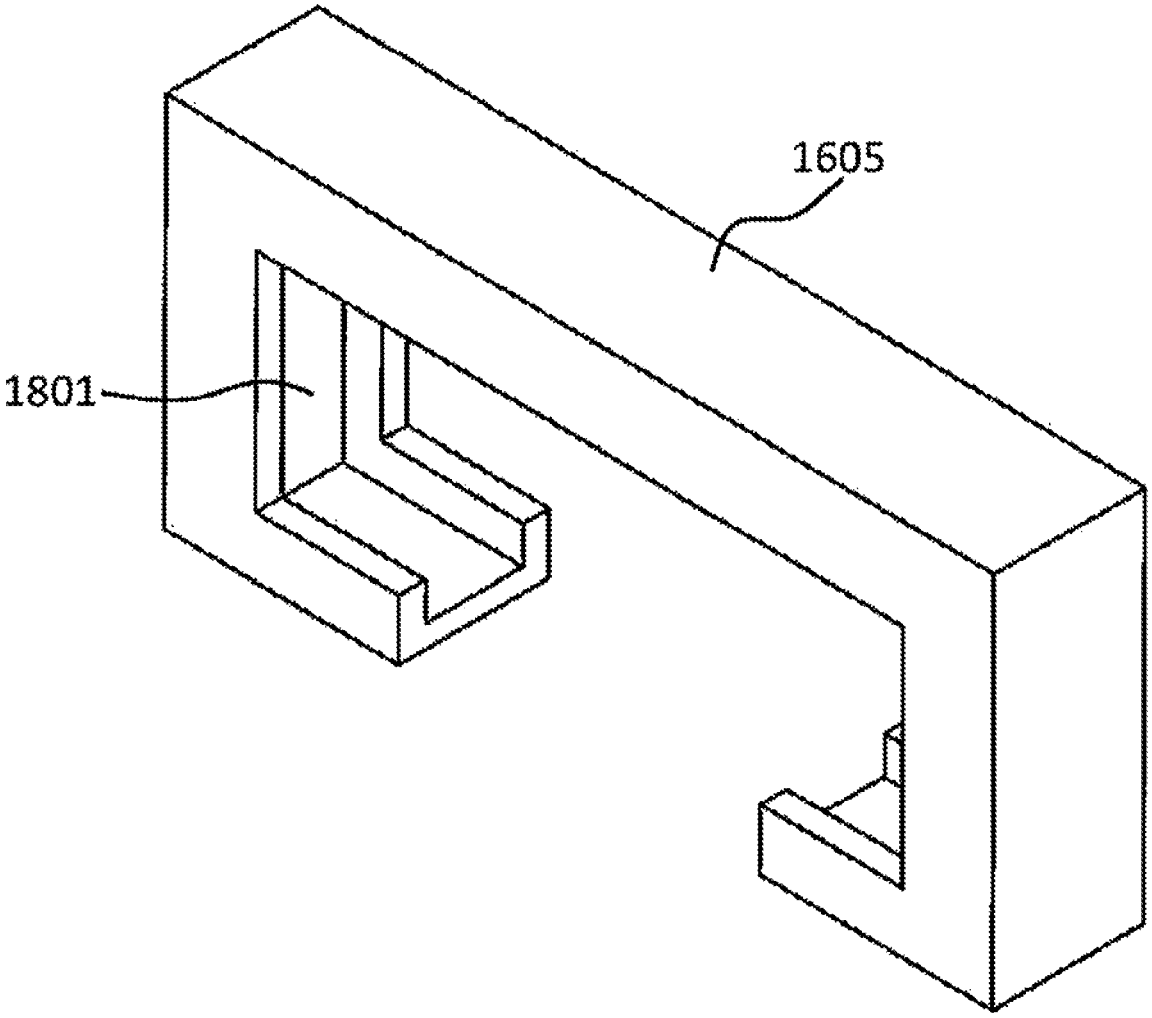
FIG. 21 is a diagram illustrating a three-dimensional diagram of the inductor winding in FIG. 20 in an embodiment of the present invention.

Thirdly, flat wires with groove can be used to form the inductor winding, as illustrated in FIG. 20 and FIG. 21. FIG. 21 illustrates a three-dimensional diagram of the inductor winding in FIG. 20. The groove 1801 is located in the flat wires that used as the inductor winding 1605. The grooves can be U-shaped, and the depth s2 is larger than ⅕ of the width w of the inductor winding. Generally, under such a condition, the loss generated by the fringing flux of the air gaps can be ignored. The shape of the grooves 1801 is not limited to U-shape and can be arc or other shapes. The width w1 of the groove 1801 can be larger than the width of the air gaps. The advantage of using the flat wires with the grooves to manufacture the inductor winding is that: when the winding and the magnetic core are assembled, the winding can abut on the magnetic pillar with air gaps so as to control the distance between the winding and the magnetic pillar having the first low permeability structure (i.e. air gaps).

Figure 22:
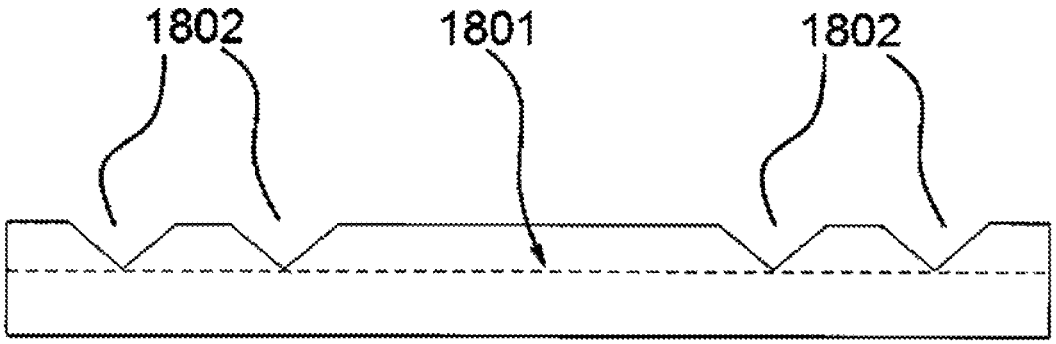
FIG. 22 is a diagram illustrating a diagram of an unfolded inductor winding illustrated in FIG. 21 in an embodiment of the present invention.

Reference is now made to FIG. 22. FIG. 22 is a diagram of an unfolded inductor winding illustrated in FIG. 21. A section of straight flat wire having a groove can be bent in order to obtain the winding structure illustrated in FIG. 21. In order to be bent easily and to decrease the degree of deformation, an opening, such as a V-shaped opening 1802, can be disposed in the straight flat wire having the groove. In an embodiment, the V-shaped opening 1802 can be 90 degrees. The size of the V-shaped opening can increase or decrease according to the practical requirements. Further, the shape of the opening is not limited to V-shape, and can be arc shape or other shapes.

Figure 23:
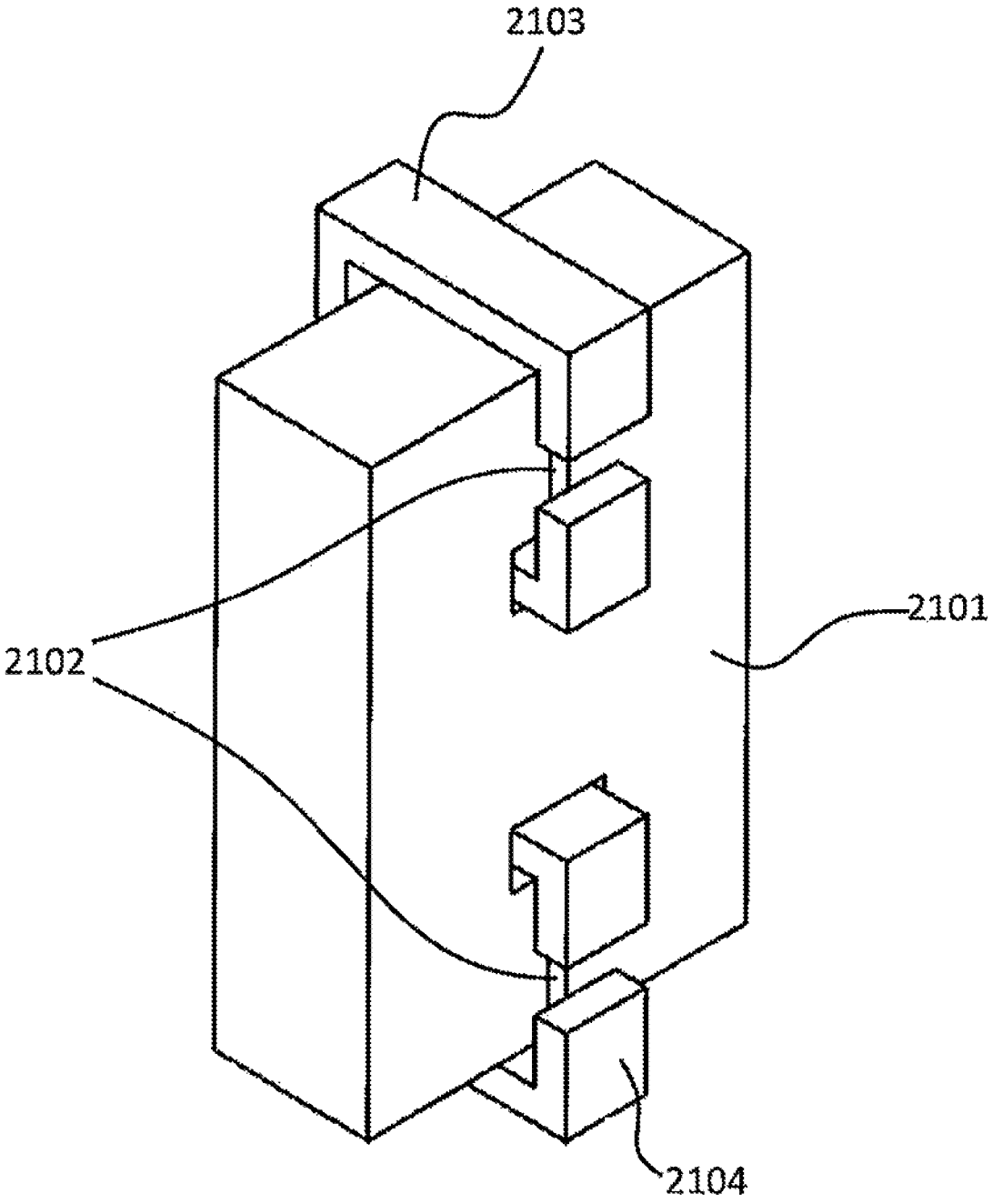
FIG. 23 is diagram of a structure of a two-phase integrated inductor in an embodiment of the present invention.

Reference is now made to FIG. 23. FIG. 23 is diagram of a structure of a two-phase integrated inductor in an embodiment of the present invention. The magnetic core 2101 of the two-phase integrated inductor includes two magnetic core units each having an air gap 2102. The two air gaps 2102 are disposed at the central position of the non-common magnetic pillars of the two magnetic core units respectively that are in parallel with the common magnetic pillars therein. The two inductor windings 2103 and 2104 are both flat wires and are wound at the non-common magnetic pillars having the air gaps. The direction of the width W of the inductor winding is in parallel with the non-common magnetic pillar that the air gaps are disposed. The integrated inductor can be used in a multi-phase paralleled buck circuit, a multi-phase paralleled boost circuit or other circuits that are similar to these two circuits. Since the magnetic coupling between different phases integrated inductor is weak, the integrated inductor is equivalent to a discrete inductor. There is no requirement of the phase difference of the switch signal of each of the parallel-connected paths. For example, in an embodiment, the switch signals of different parallel-connected paths are synchronized. In another embodiment the switch signals of different parallel-connected phases have a certain delay. For example, the delay time is T/N, in which T is the switch period and N is the number of parallel-connected paths.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A magnetic component comprising:

a magnetic core comprising a plurality of magnetic core units, wherein each having at least one shared magnetic core part that is shared with a neighboring magnetic core unit and at least one non-shared magnetic core part that is not shared with the neighboring magnetic core unit, wherein a reluctance of the shared magnetic core part is smaller than the reluctance of a non-shared magnetic core part of the magnetic core units; and a plurality of windings, each disposed to be correspondingly wound at the non-shared magnetic core part of the magnetic core unit, wherein in each the shared magnetic core part shared by neighboring two magnetic core units, the directions of the direct current magnetic fluxes that are generated by windings of the neighboring two magnetic core units respectively are opposite, wherein the shared magnetic core part comprises a common magnetic pillar, and the non-shared magnetic core part comprises a first magnetic pillar and a second magnetic pillar, and the first magnetic pillar and the second magnetic pillar are perpendicular to the common magnetic pillar, wherein the first magnetic pillar or the second magnetic pillar comprises at least one magnetic section that has a permeability within a range of 1~50, wherein the at least one magnetic section is disposed at one of the first magnetic pillar and the second magnetic pillar, and each of the windings is disposed respectively at another one of the first magnetic pillar and the second magnetic pillar to form a distance between the winding and the at least one magnetic section.

2. The magnetic component of claim 1, wherein the magnetic section is one or more air gaps.

3. The magnetic component of claim 2, wherein the magnetic section comprises a plurality of air gaps, which are distributed on the same magnetic pillar or distributed on different magnetic pillars individually.

4. The magnetic component of claim 1, wherein in the first magnetic pillar or the second magnetic pillar, other parts thereof except the magnetic section are manufactured by using material having the same permeability as the common magnetic pillar.

5. The magnetic component of claim 1, wherein the first magnetic pillar and the second magnetic pillar have a first permeability, the common magnetic pillar has a second permeability, and the second permeability is larger than the first permeability.

6. The magnetic component of claim 1, wherein each of the magnetic core units comprises at least one magnetic pillar, and the shared magnetic core part and the non-shared magnetic core part are disposed on different positions of the same magnetic pillar.

7. The magnetic component of claim 1, wherein each of the magnetic core units comprises at least two magnetic pillars, and the number of magnetic pillars that the shared magnetic core part is disposed is larger than or equal to 2.

8. The magnetic component of claim 1, wherein the magnetic core units further comprise a magnetic core top cover and a magnetic core base, wherein the magnetic core top cover is disposed above the magnetic core base to form a geometrical structure, wherein the magnetic core top cover forms the first magnetic pillar and the second magnetic pillar, and the magnetic section is disposed at the magnetic core top cover.

9. The magnetic component of claim 1, wherein the magnetic core is an integrated inductor magnetic core.

10. The magnetic component of claim 1, wherein each of the plurality of windings is disposed to be correspondingly wound at the one of the magnetic pillars that the magnetic section is disposed.

11. The magnetic component of claim 10, wherein a coupling coefficient between the windings of two of the neighboring magnetic cores is smaller than 0.15.

12. The magnetic component of claim 1, wherein each of the plurality of windings is disposed to be correspondingly wound at the other magnetic pillar which is opposite to the magnetic pillar that the magnetic section is disposed.

13. The magnetic component of claim 1, wherein the magnetic core comprises an I-shaped magnetic core top cover and a magnetic core base, wherein the magnetic core base is formed by combing at least one E-shaped magnetic core and/or at least one U-shaped magnetic core, and the magnetic section is disposed at the magnetic core top cover, wherein the plurality of windings are wound at a connection part of the E-shaped magnetic core, the connection part of the U-shaped magnetic core or the magnetic core top cover.

14. The magnetic component of claim 1, wherein the magnetic core comprises a first magnetic core unit and a second magnetic core unit disposed side by side, each of the first and the second magnetic core units comprises a common magnetic pillar, a first magnetic pillar and a second magnetic pillar perpendicular to the common magnetic pillar, and a third magnetic pillar parallel to the common magnetic pillar, wherein the third magnetic pillar comprises one or more air gaps and the windings are wound at the third magnetic pillar of each of the magnetic core units.

15. The magnetic component of claim 1, wherein the windings are flat wires, wherein a cross-sectional surface of the flat wires is rectangular, a width of the flat wires is w, and a distance s1 between the flat wires and the magnetic pillar that the magnetic component is disposed satisfies:

$s1>w/5$.

16. The magnetic component of claim 1, wherein the windings are flat wires with grooves, and the grooves are U-shaped or arc shape, a width of the flat wires is w, and the depth s2 of the grooves satisfies:

$s2>w/5$, wherein the width of the grooves is smaller than the width of the flat wires.

17. The magnetic component of claim 1, wherein the windings are formed by bending straight flat wires, and apertures are formed on the straight flat wires to decrease a deformation amount generated by bending the straight flat wires.

18. The magnetic component of claim 1, wherein the magnetic component is an integrated inductor disposed at a multi-phase paralleled input terminal or a multi-phase paralleled output terminal of a power converter.

19. The magnetic component of claim 18, wherein the windings of the integrated inductor has the same phase DC current and the predetermined phase difference AC current.

* * * * *